US007023348B2

(12) United States Patent
Hogan et al.

(10) Patent No.: US 7,023,348 B2
(45) Date of Patent: Apr. 4, 2006

(54) RELEASE TECHNIQUES FOR A SECURITY TAG

(75) Inventors: Dennis L. Hogan, Lighthouse Point, FL (US); John Chamberlain, Boca Raton, FL (US); Thang Nguyen, Boca Raton, FL (US); Franklin H. Valade, Jr., Lake Worth, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 54 days.

(21) Appl. No.: 10/448,992

(22) Filed: May 30, 2003

(65) Prior Publication Data

US 2004/0239505 A1 Dec. 2, 2004

(51) Int. Cl.
*G08B 13/14* (2006.01)

(52) U.S. Cl. ..... 340/572.8; 340/572.9

(58) Field of Classification Search ..... 340/572.8, 340/572.9, 572.1; 24/704.1
See application file for complete search history.

(56) References Cited

U.S. PATENT DOCUMENTS

| | | | | |
|---|---|---|---|---|
| 4,000,543 | A * | 1/1977 | Paskert | 340/572.8 |
| 4,156,302 | A * | 5/1979 | Van Niel | 24/707.5 |
| 4,774,503 | A * | 9/1988 | Bussard | 340/572.9 |
| 4,774,504 | A * | 9/1988 | Hartings | 340/572.5 |
| 4,993,245 | A * | 2/1991 | Ott | 70/57.1 |
| 5,426,419 | A * | 6/1995 | Nguyen et al. | 340/572.9 |
| 6,191,692 | B1 * | 2/2001 | Stoltz et al. | 340/572.9 |
| 6,373,390 | B1 * | 4/2002 | Hogan et al. | 340/572.8 |
| 6,474,117 | B1 * | 11/2002 | Okuno | 70/57.1 |
| 6,535,130 | B1 * | 3/2003 | Nguyen et al. | 340/572.9 |

* cited by examiner

*Primary Examiner*—John Tweel, Jr.

(57) ABSTRACT

Techniques to release a security tag are described. One embodiment may comprise a tag housing, a tack body, and a linear clamp disposed within the tag housing to retain the tack body. The linear clamp may move in a substantially linear direction in response to force to release the tack body from the linear clamp. Other embodiments are described and claimed.

48 Claims, 21 Drawing Sheets

RELEASE TECHNIQUES FOR A SECURITY TAG

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to the monitored item, such as an article of clothing. If the monitored item enters the surveillance zone, an alarm may be triggered indicating unauthorized removal.

The security tag may be fastened to a number of different items. It may be desirable for the fastening system to allow authorized release of the security tag, while making unauthorized release relatively difficult. Consequently, there may be a need for improved techniques in security tags in general, and fastening systems for security tags in particular.

SUMMARY

The embodiments may be directed to a security tag for an EAS system. In one embodiment, for example, a security tag may comprise a tag housing, a tack body, and a linear clamp disposed within the tag housing to retain the tack body. The linear clamp may move in a substantially linear direction in response to force to release the tack body from the linear clamp. The embodiments are not limited in this context.

BRIEF DESCRIPTION OF THE DRAWINGS

The subject matter regarded as embodiments of the invention is particularly pointed out and distinctly claimed in the concluding portion of the specification. Embodiments of the invention, however, both as to organization and method of operation, together with objects, features, and advantages thereof, may best be understood by reference to the following detailed description when read with the accompanying drawings in which:

DETAILED DESCRIPTION

Embodiments of the invention may be directed to techniques for attaching and detaching a security tag. For example, one embodiment of the invention may comprise a security tag having a tag housing, tack body and linear clamp. To attach the security tag to an item, such as an article of clothing, the tack body may be inserted through the article of clothing and into a hole in the tag housing. The linear clamp may be disposed within the tag housing to receive and retain the tack body, thereby completing the attachment process. To detach the security tag, a detachment device having a detachment probe may be used to apply force to the linear clamp. The force may move the linear clamp in a substantially linear direction to release the tack body from the linear clamp. The term "linear" as used herein may refer to movement in any particular direction along a substantially straight line, although the embodiments are not limited in this context. One or more interface elements may assist moving the linear clamp in the linear direction. Once the tack body has been released from the linear clamp, the tack body may be removed from the tag housing to detach the security tag from the item.

It is worthy to note that any reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

Figure 1:
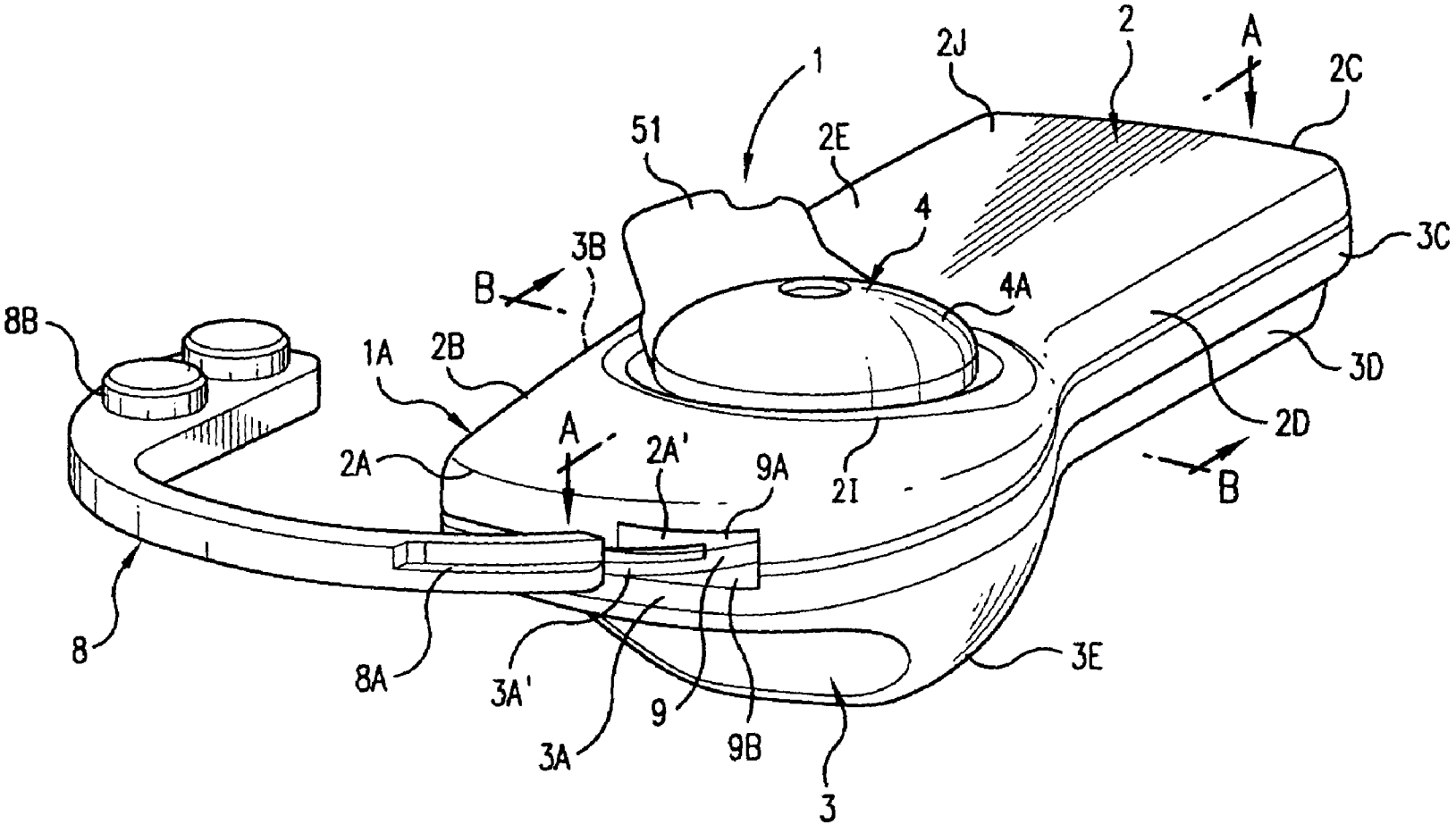
FIG. 1 illustrates a security tag in accordance with one embodiment of the invention.

Referring now in detail to the drawings wherein like parts are designated by like reference numerals throughout, there is illustrated in FIG. 1 a security tag in accordance with one embodiment of the invention. In one embodiment, FIG. 1 illustrates a security tag 1 that includes an upper housing 2 having side walls 2A, 2B, 2C and 2D, all of which are joined by a top wall 2E. Security Tag 1 also includes a lower housing 3 having side walls 3A, 3B, 3C and 3D, which are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A.

In one embodiment, housings 2 and 3 are made of a hard or rigid material. A usable rigid or hard material might be a hard plastic such as, for example, an injection molded ABS plastic. If a plastic is used, the mating side walls of the housings can be joined by an ultrasonic weld 1B of FIG. 2 or like joining mechanism.

Figure 2:
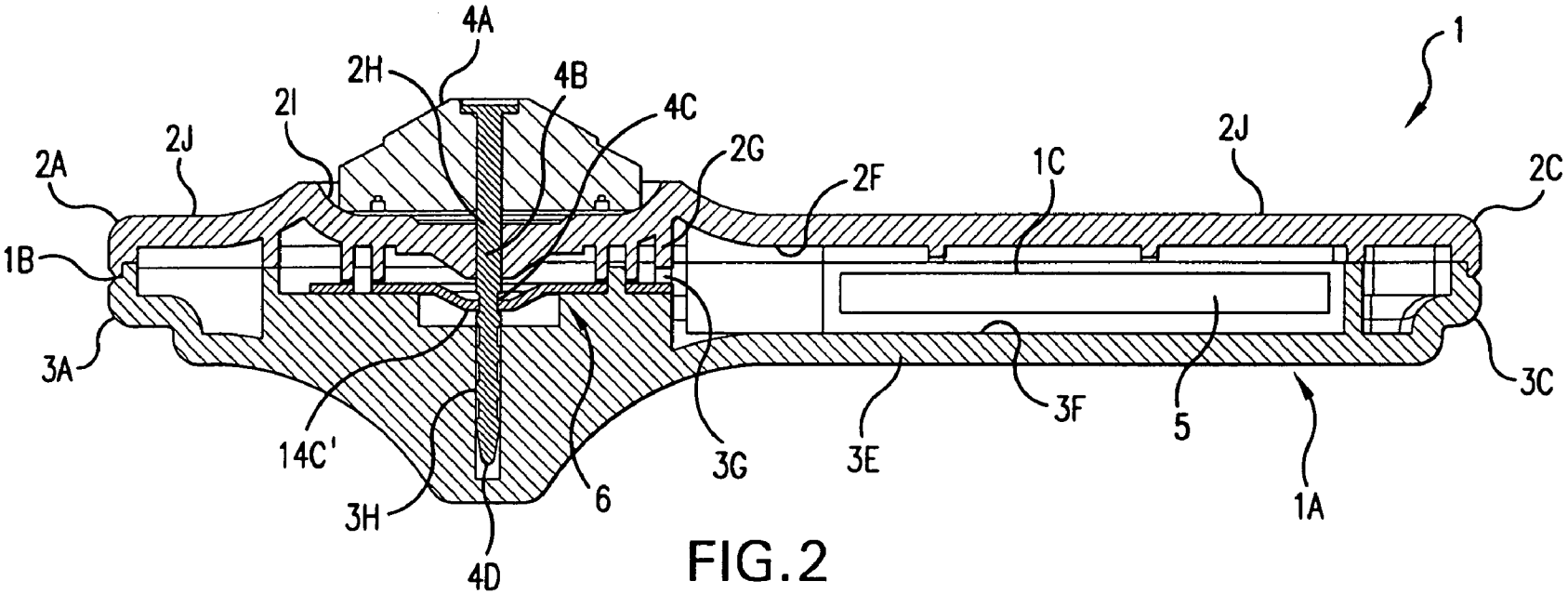
FIG. 2 illustrates a cross-section of the security tag in FIG. 1 taken along the line A—A in accordance with one embodiment of the invention.

Security tag 1 may further include a tack assembly 4 shown as having an enlarged tack head 4A and an elongated tack body 4B provided with slots or grooves 4C and a pointed forward end 4D, as shown in FIG. 2. Tack assembly 4 may be used to attach the tag body 1A to an article 51 that is to be protected by security tag 1. In this embodiment, article 51 may comprise, for example, an article of clothing.

FIG. 2 illustrates a cross-section of the security tag in FIG. 1 taken along the line A—A in accordance with one embodiment of the invention. In order to sense security tag 1 and, therefore, detect the presence of the tag and the attached article 51, inner surfaces 2F and 3F of the walls 2E and 3E of the housings 2 and 3 are provided with frame members 2G and 3G which together define an interior cavity 1C for receiving an EAS sensor 5. EAS sensor 5 generates detectable signals and can be an acoustically resonant magnetic sensor, as disclosed in U.S. Pat. No. 4,510,489 and U.S. Pat. No. 4,510,490. Possible other magnetic EAS sensors suitable for sensor 5 might be those disclosed in U.S. Pat. No. 4,686,516 and U.S. Pat. No. 4,797,658, while possible representative radio-frequency (RF) EAS sensors might be those disclosed in U.S. Pat. No. 4,429,302 and U.S. Pat. No. 4,356,477.

Figure 3:
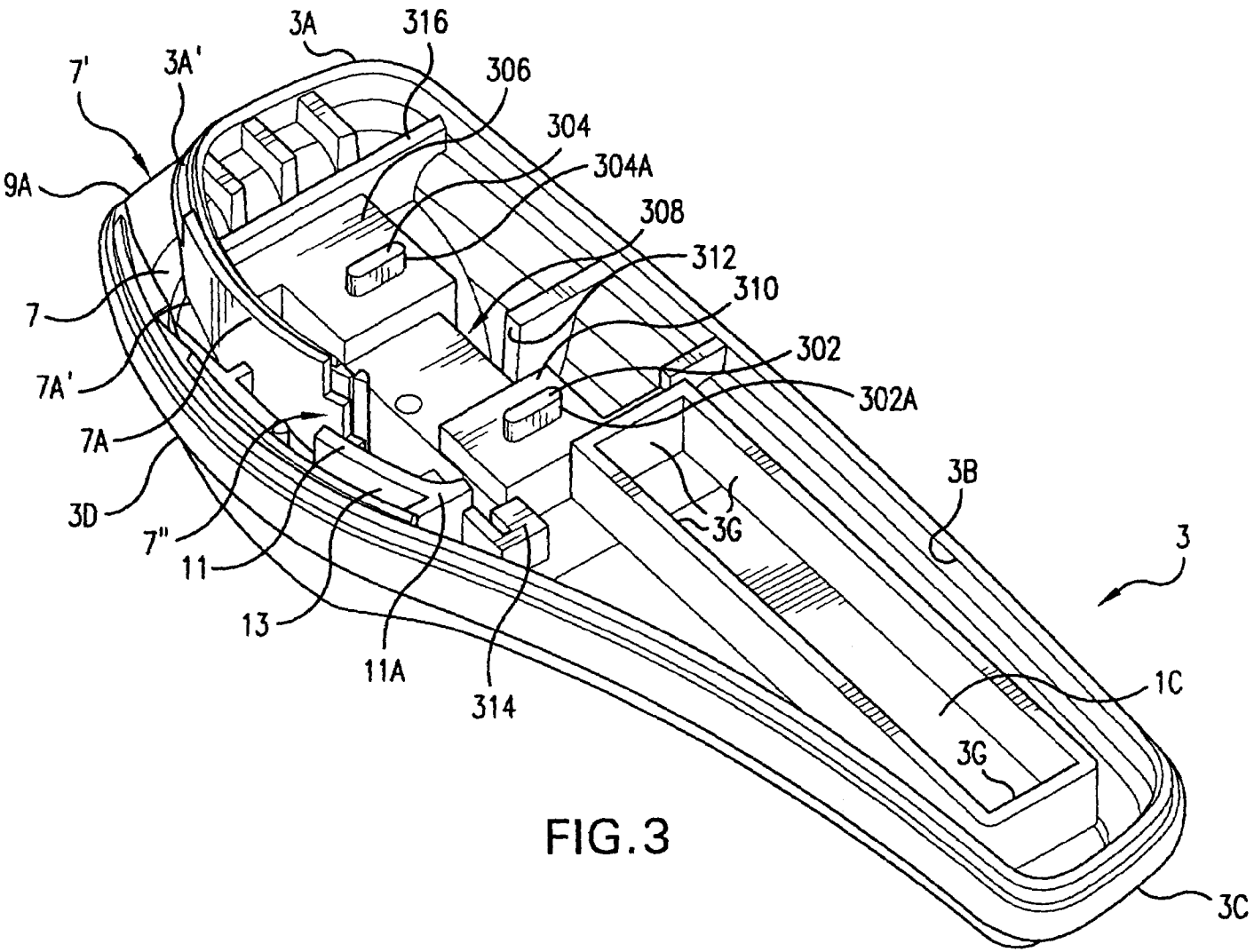
FIG. 3 illustrates a view of the interior of the lower housing of a security tag in accordance with one embodiment of the invention.
Figure 4B:
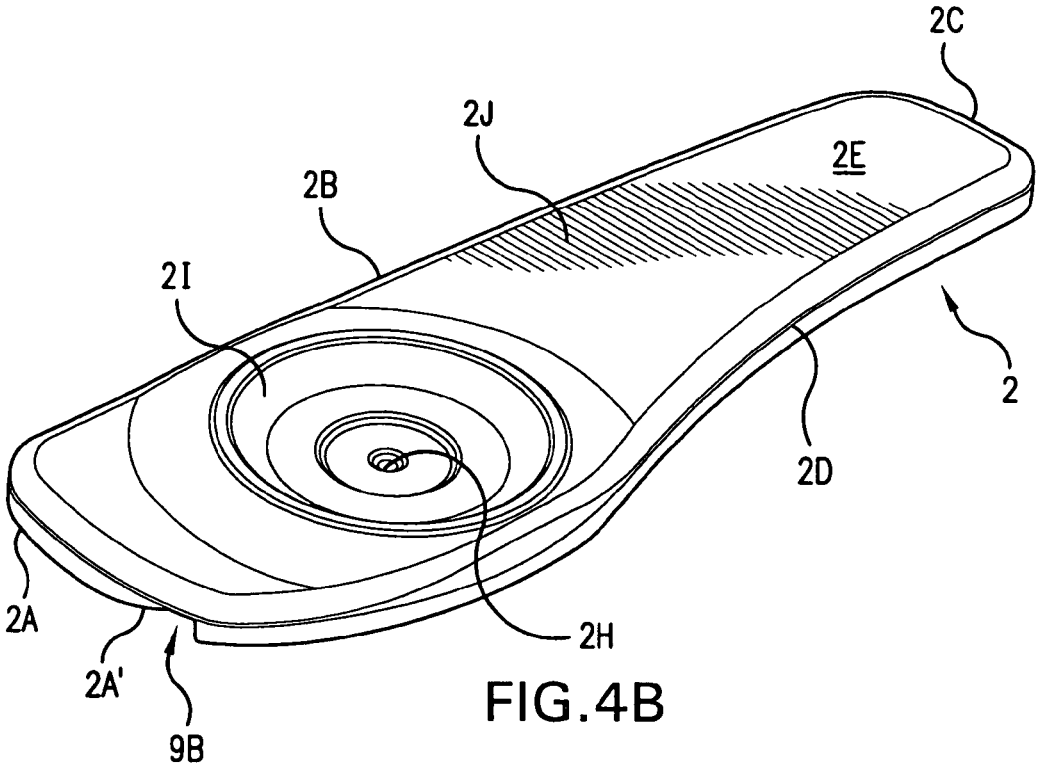
FIG. 4B illustrates a view of the exterior of the upper housing of a security tag in accordance with on embodiment of the invention.
Figure 4A:
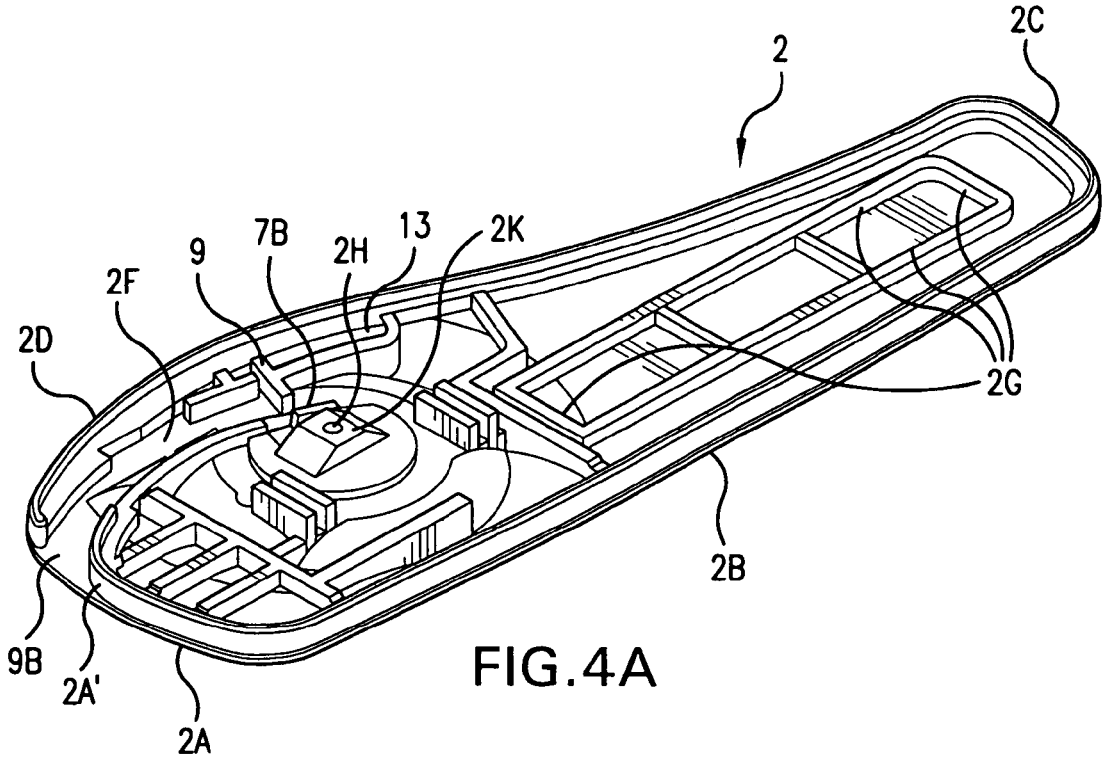
FIG. 4A illustrates a view of the interior of the upper housing of a security tag in accordance with one embodiment of the invention.

FIGS. 3, 4A and 4B illustrate the internal and external features for a body of security tag 1. More particularly, FIG. 3 illustrates a view of the interior of the lower housing of a security tag in accordance with one embodiment of the invention. FIG. 4A illustrates a view of the interior of the upper housing of a security tag in accordance with one embodiment of the invention. FIG. 4B illustrates a view of the exterior of the upper housing of a security tag in accordance with one embodiment of the invention. The features of FIGS. 3, 4A and 4B will be discussed in more detail below.

Referring again to FIG. 1, article 51 may be joined to tag body 1A by tack assembly 4. This may be accomplished by inserting tack body 4B into an opening 2H in the wall 2E of upper housing 2. When tack body 4B is fully inserted, the pointed end 4D of the tack is received in an upstanding cavity or collar 3H extending from the inner surface 3F of the lower housing wall 3E. The tack head 4A, in turn, seats in a recessed area 2I in the upper surface 2J of the wall 2E. Article 51 is thus held between the tack head 4A and the latter wall.

Figure 5:
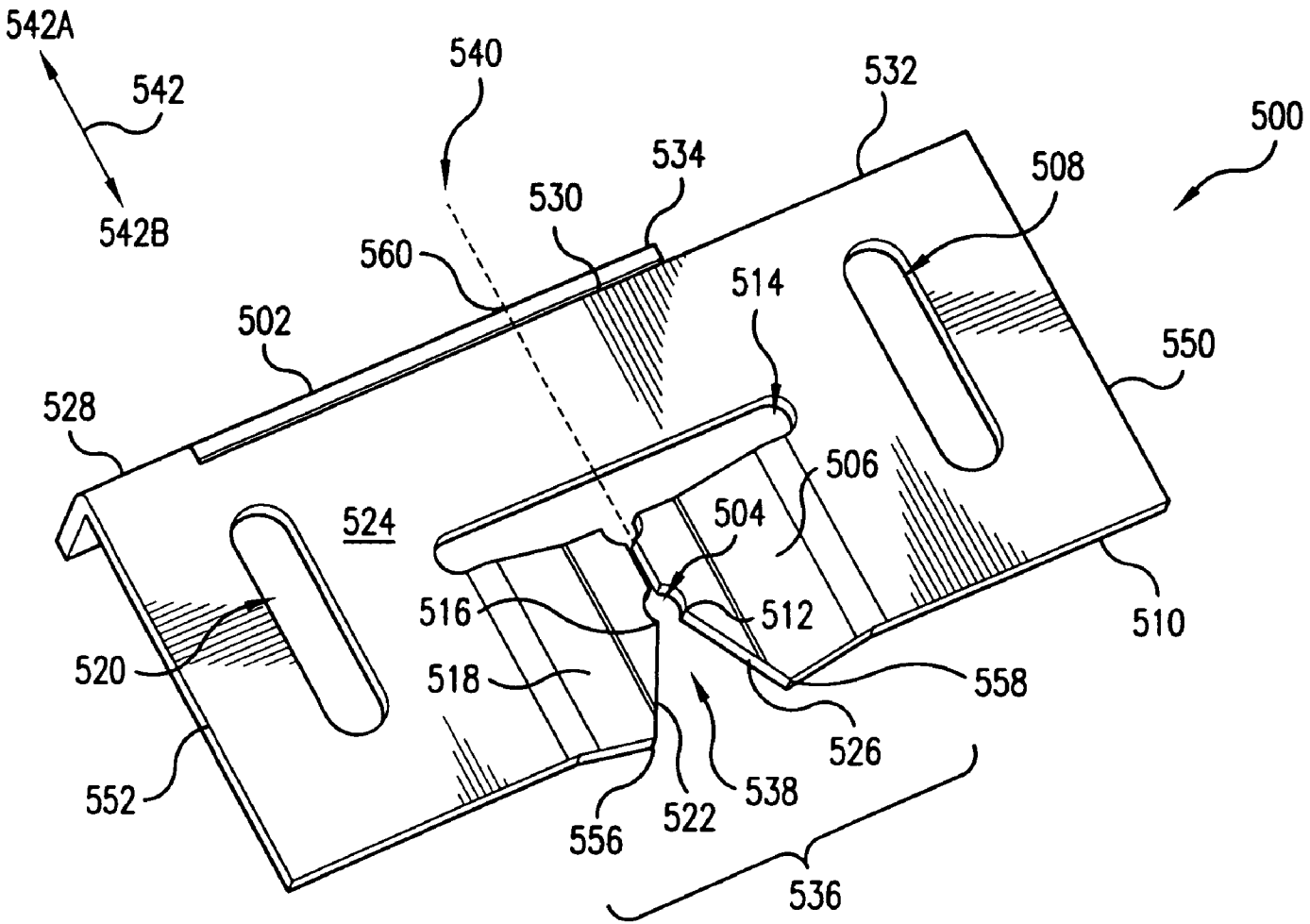
FIG. 5 illustrates an exploded view of a first linear clamp used in the security tag of FIG. 1 in accordance with one embodiment of the invention.

Security tag 1 may also include a linear clamp 500 as shown in FIG. 5. Linear clamp 500 may be disposed within tag body 1A for releasably preventing the tack body from being withdrawn from the tag body. Tack assembly 4 and article 51 thus become releasably locked to security tag 1 by linear clamp 500. Tack assembly 4 may be released from linear clamp 500 by moving it in a linear direction in response to a force. Linear clamp 500 will be discussed in greater detail with reference to FIG. 5 below.

In this embodiment, security tag 1 may be further adapted so that access to linear clamp 500 for releasing same is made difficult for other than authorized personnel. To this end, tag body 1A may be configured so that access to linear clamp 500 is through an arcuate channel 7, as shown in FIG. 3. Arcuate channel 7 may be a channel conforming to an arcuate probe 8. Arcuate channel 7 may be defined by any elements or structures, such as walls, posts or abutments, and the embodiments are not limited in this context. For example, arcuate channel 7 may be bordered by one or more inner walls and by parts of the side walls, as well as the upper and lower walls of tag body 1A. With this configuration, probe 8 conforming to arcuate channel 7 may be used to reach and release linear clamp 500 and, thus, detach tack assembly 4 and article 51 from tag body 1A.

As shown in FIG. 3, arcuate channel 7 may be bordered by a curved inner wall 7A. This wall extends upward from the inner surface 3F of the bottom housing 3 to abut the inner surface of an upper housing 2 security tag 1. The wall 7A is further spaced from the side wall 3D of the bottom housing 3, and its outward end 7A' terminates at an inward curved part 3A' of the side wall 3A. The inward curved part 3A' of the wall 3A results in a space or slot 9A between the side walls 3A and 3D of the lower housing 3.

Slot 9A cooperates with a similar slot 9B between side walls 2A and 2D of an upper housing 2 to define a second opening 9 for providing entry or access into the outward end 7' of the channel 7. At this entry point, side wall 2A also curves inwardly at a part 2A', the latter part 2A' mating with a curved side wall part 3A' of a side wall 3 of the lower housing 3.

Channel 7 may be further defined by a second curved wall 7B extending downwardly from an inner surface 2F of upper housing 2. Wall 7B may be situated outward of the inner end of curved wall 7A and extends beyond this end to a frame member 2G.

The presence of wall 7B may change or alter the configuration of channel 7 at its inner end 7" that lies adjacent to linear clamp 500. This change or alteration in configuration defines a keyway for channel 7 which may accommodate probe 8 to pass through channel 7 and gain access to linear clamp 500. In this case, wall 7B may change the channel cross section from substantially rectangular to substantially L-shaped, for example.

Adjacent inner end 7" of channel 7, lower housing 2 and upper housing 3 may further be provided with curved walls 9 and 11, which may terminate in wall sections 9A and 11A abutting the end walls 2D and 3D. Walls 9 and 11 are outward of channel 7 and, with the end walls 2D and 3D, define a trap area 13 that may prevent access to linear clamp 500. This area provides a safety measure for blocking unauthorized objects introduced into channel 7 of tag body 1A in an attempt reach linear clamp 500.

FIG. 5 illustrates an exploded view of a first linear clamp in accordance with one embodiment of the invention. FIG. 5 illustrates an exploded view of a first linear clamp that may be used in security tag 1 in accordance with one embodiment of the invention. Linear clamp 500 may be adapted to releasably prevent tack body 4B from being withdrawn from tag body 1A. Linear clamp 500 may release tack body 4B in response to probe 8 moving in arcuate channel 7.

In one embodiment, linear clamp 500 may release tack body 4B by moving in a linear direction. As previously defined, a linear direction may refer to movement in any particular direction along a substantially straight line, although the embodiments are not limited in this context. This may be contrasted with rotational movement around a pivot point, for example. In one embodiment, a linear direction is shown by line 542. The arrows 542A and 542B at each end of line 542 indicate that linear clamp 500 may move along line 542 in either direction. For example, linear clamp 500 may move in direction 542A to detach linear clamp 500 from tack body 4B, and direction 542B to return to its initial position. Although line 542 is used by way of example, it can be appreciated that any linear direction may be used and still fall within the scope of the invention.

In one embodiment, linear clamp 500 comprises a clamp body 524 and a tack retaining body 536. Tack retaining body 536 may be an integral part of clamp body 524. Tack retaining body 536 may comprise jaws 506 and 518. Jaws 506 and 518 each extend outwardly of the plane of the clamp body 524 and then inwardly toward the other jaw. Jaws 506 and 518, furthermore, terminate in facing edges 522 and 526. These edges extend from a common edge 510 of clamp body 524 inwardly toward each other to form a jaw open area 538. The edges may then curve outwardly away from each other to define an aperture 504 for receiving tack body 4B. Aperture 504 may be, for example, circular or elliptical in shape. Aperture 504 may also have a release section allowing movement of a tack body from aperture 504 to jaw open area 538 in response to linear movement of linear clamp 500. The release section may be defined as the area between release points 512 and 516, for example. Edges 522 and 526 then continue in aligned fashion and end in an elongated slot 514 in clamp body 524.

In one embodiment, joint area 528 may attach an elongated spring arm 502 to a side 530 of an edge 532. Elongated spring arm 502 may extend along the length of edge 532 and is also out of the plane of clamp body 524. In one embodiment, linear clamp 500 may have various structures to support movement of linear clamp 500 in linear direction 542. In one embodiment, linear clamp 500 uses a set of slots 508 and 520. Slots 508 and 520 are designed to conform to corresponding guide rails 302 and 304, respectively, which are formed in lower housing 3. The guide interface allows for linear movement in linear direction 542. Elongated spring arm 502 may bias linear clamp 500 against one or more abutments to establish the initial position for linear clamp 500. The initial position may be defined as the position of linear clamp 500 when one end of slots 508 and 520 are near or in contact with abutments 302A and 304A of guide rails 302 and 304, respectively. Alternatively, elongated spring arm 502 may bias or contain linear clamp 500 near one or more abutments to establish the initial position area, on the order of one-quarter the diameter of groove 4C. In one embodiment, the pressure point of elongated spring arm 502 may be against the tag housing on a line 540 that goes through the center of aperture 504, for example. It is worthy to note that line 540 may be moved and still fall within the scope of the invention.

It can be appreciated that other guide interfaces may be used to assist movement of linear clamp 500 in linear direction 542. For example, in one embodiment lower housing 3 may have a pair of rectangular guides or guide posts making contact against corresponding sides 550 and 552 of linear clamp 500. The guides may be positioned to limit rotational movement while emphasizing linear movement. In another example, linear clamp 500 may have flanges attached to sides 550 and 552, respectively. In this embodiment, lower housing 3 may have a pair of corresponding rails to accommodate the flanges, and allow the flanges to move in linear direction 542 while limiting rotational movement. The embodiments are not limited with respect to these and other structures to assist guiding linear clamp 500 in a linear direction, or abutments to establish the initial position.

In one embodiment, the amount of linear movement may be at least one diameter of tack body 4B from the initial position, but limits movement normal to the slots to approximately one-quarter the diameter of tack groove 4C. This maintains the alignment of aperture 504 and the tack hole of the tag housing. Clamp body 524 may be supported by various support structures in lower housing 3, such as supports 306 and 310, for example. Elongated spring arm 502 may rest with center point 560 against an abutment 312. Cutaway area 308 between supports 306 and 310 and facing abutment 312 may provide space for end 534 of elongated spring arm 502 to flex unobstructed under clamp body 524 when linear clamp 500 moves in direction 542A.

Linear clamp 500 may assist in fastening security tag 1 to article 51. When pointed end 4D of tack body 4B is introduced in the downward linear direction through an opening 2H in upper housing 2, part 2K of upper housing 2, which part is shaped to fit within the hollow of the spring clamp body 524 above jaws 506 and 518, and carries opening 2H, directs the tack body to aperture 504 defined by facing edges 522 and 526 of the jaws. This causes the jaws to spread or open and allow tack body 4B to pass through the jaws. When downward tack travel is stopped at a particular slot 4C, e.g., a slot that secures tack head 4A and article 51 to wall 2E of upper housing 2, jaws 506 and 518 retract and clutch tack body 4B. In this position, jaws 506 and 518 may prevent upward movement of tack 4. Tack 4 and article 51 thus become locked to tag body 1A.

Linear clamp 500 may also assist in unfastening security tag 1 from article 51. For example, an arcuate probe 8 may be introduced into channel 7 of tag body 1A. This may continue until the L-shaped forward end 8A of probe 8 passes into the L-shaped inner end 7" of channel 7. This may bring probe end 8A towards common edge 510 of clamp body 524. Probe end 8A may provide force to linear clamp 500. The force may move linear clamp 500 in a linear direction 542A. Jaws 506 and 518 are thus enabled to spread apart or open due to the force on tack body 4B, which is held stationary by a collar 3H and hole 2H, acting on the walls of aperture 504. Aperture 504 thus expands, releasing tack body 4B from jaws 506 and 518 through a release section defined by points 512 and 516. Tack body 4B may be released into jaw open area 538. Tack 4 can now be moved in the upward linear direction past jaws 506 and 518, via an upward force on tack head 4A. Tack 4 may thus be withdrawn and separated from tag body 1A, and article 51 from security tag 1.

In one embodiment, an interface element may be used to translate the force from probe 8 to linear clamp 500 in a manner that facilitates movement in linear direction 542A. Since the line of force generated by probe 8 may be towards side 550, linear clamp 500 may have a tendency to rotate prior to moving in linear direction 542A. The interface elements discussed within assist in translating the probe force along line 540 through the approximate center of linear clamp 500, thereby reducing the undesired rotation. Various interface elements to translate the probe force are discussed below.

Figure 6:
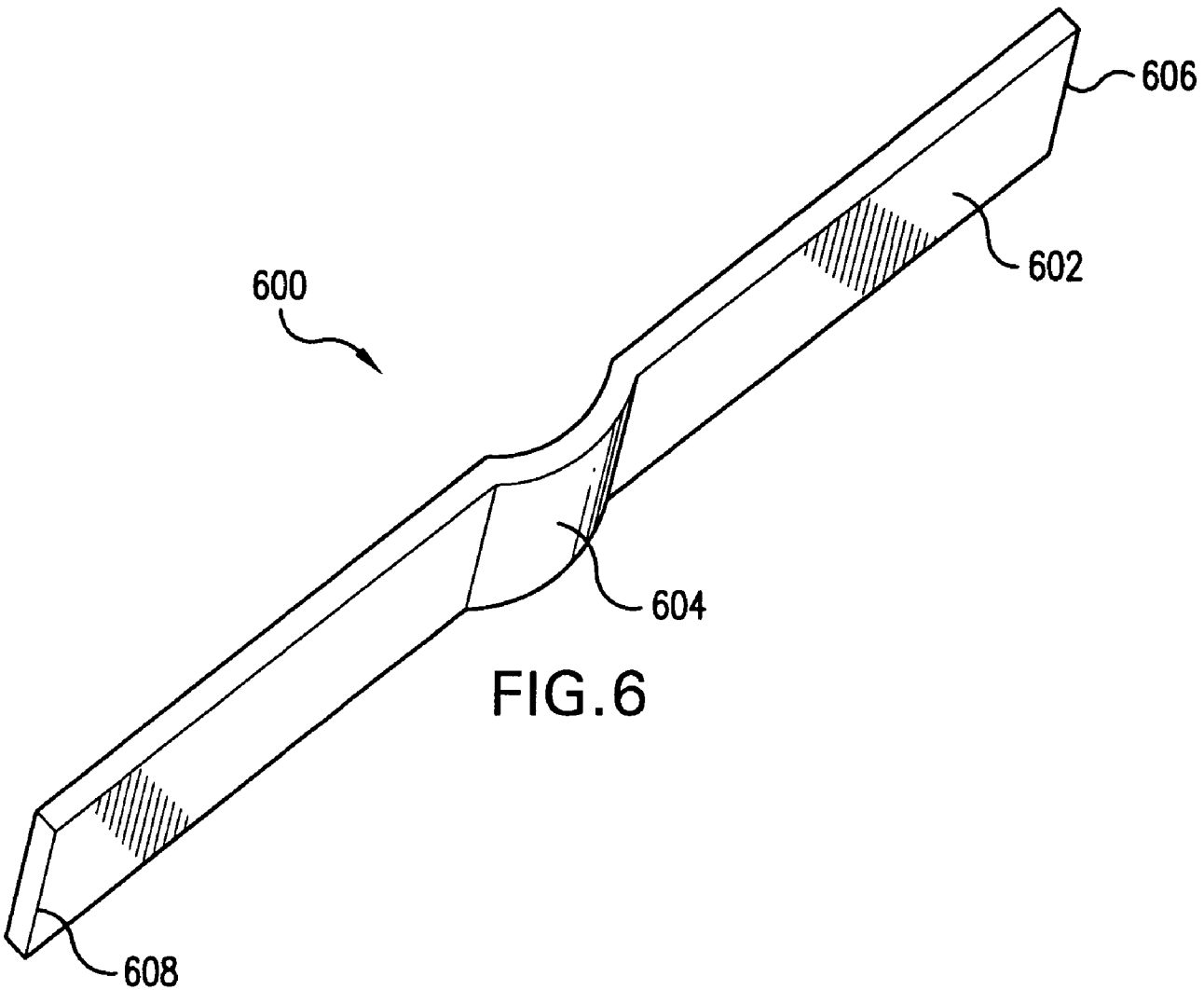
FIG. 6 illustrates a perspective view of a first interface element in accordance with one embodiment of the invention.

FIG. 6 illustrates a perspective view for a first interface element in accordance with one embodiment of the invention. FIG. 6 illustrates a first interface element 600. In one embodiment, first interface element 600 comprises a flexible rectangular flat spring steel shaped similarly to elongated spring arm 502. Further, it comprises a flat side 602 with a curved portion 604 and ends 606 and 608. In one embodiment, first interface element 600 may be approximately one inch long, 0.2 inch high and 0.015 inch thick, although the embodiments are not limited in this context.

In one embodiment, first interface element 600 may be used to assist the translation of force from probe 8 to linear clamp 500. The translated force may assist linear clamp 500 to move in linear direction 542A during the process of releasing security clamp 1 from article 51. First interface element 600 may be discussed in more detail with reference to FIG. 7.

Figure 7:
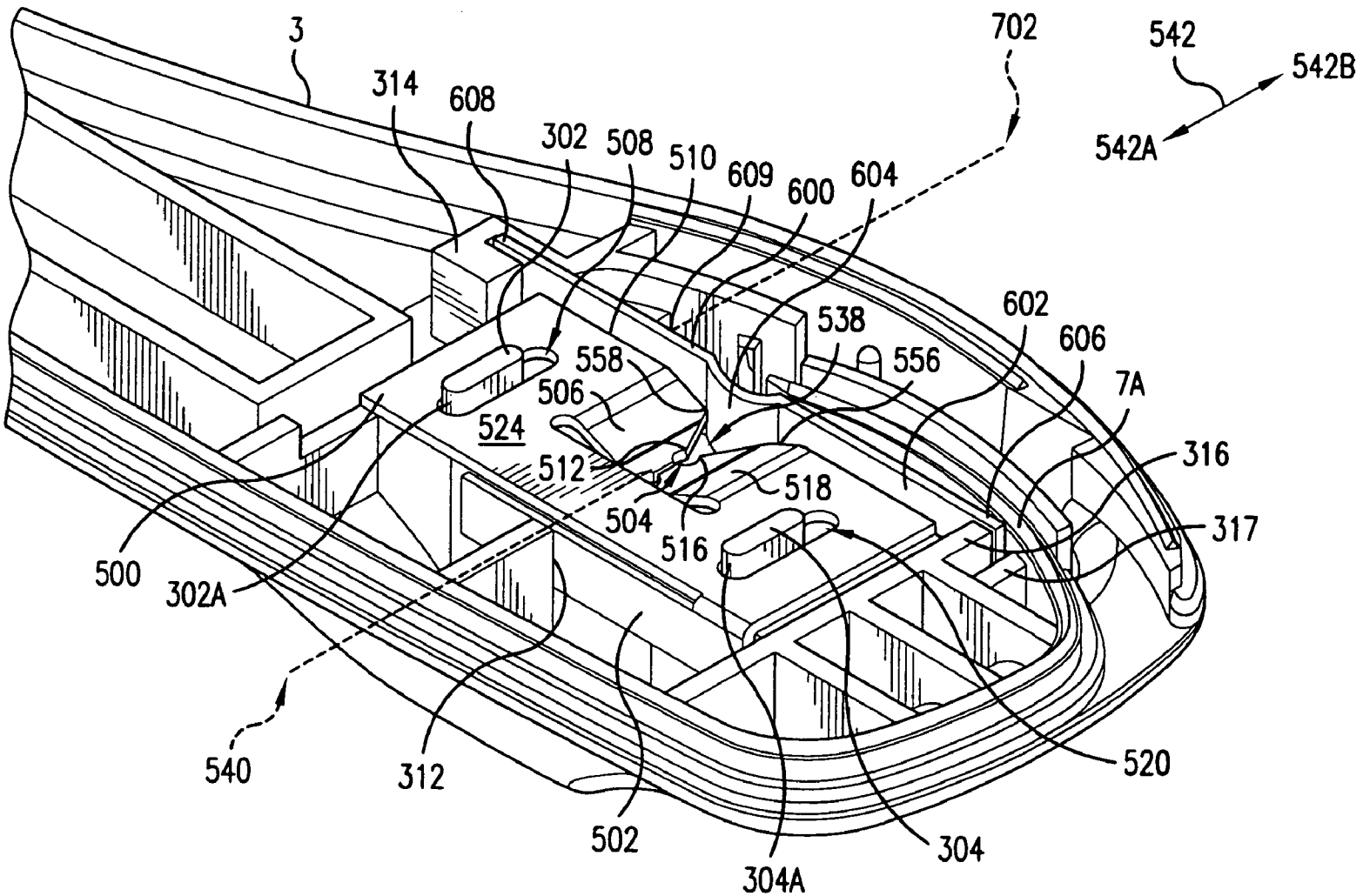
FIG. 7 illustrates a view of the interior of the lower housing of the security tag of FIG. 1 with a linear clamp and first interface element in accordance with one embodiment of the invention.

FIG. 7 illustrates a view of the interior of the lower housing of the security tag of FIG. 1 with a linear clamp and first interface element in accordance with one embodiment of the invention. FIG. 7 illustrates linear clamp 500 and a first interface element 600 as disposed within lower housing 3. Linear clamp 500 and first interface element 600 are disposed within lower housing 3 in such a manner as to facilitate movement of linear clamp 500 in linear direction 542A in response to an external force, such as generated by probe 8, for example.

As shown in FIG. 7, first interface element 600 may be inserted into lower housing 3. End 608 may be loosely inserted into mount 314, and end 606 may be loosely inserted into a slot formed by walls 316 and 7A, and abutment 317, as shown. The mounting locates surface 602 near edge 510 such that surface 602 is normal to edge 510, and the 0.2 inch dimension of surface 602 is approximately centered on edge 510. Curved portion 604 may be touching linear clamp 500, but does not necessarily apply any pressure. The mounting positions curved portion 604 opposite jaw open area 538 made by jaws 506 and 518. It is worthy to note that curved portion 604 of first interface element 600 may be contoured slightly to improve contact with jaws 506 and 518. The mounting may constrain first interface element 600 in all linear directions except for allowing it to bow or flex causing curved surface 604 to contact corners 556 and 558. It may be appreciated that the mounts for interface element 600 may be placed in other areas of lower housing 3 and still fall within the scope of the invention.

In one embodiment, first interface element 600 may transfer force from probe 8 to move linear clamp 500 along line 540 in linear direction 542A. When probe 8 provides force to first interface element 600 along line 702, first interface element 600 may move towards linear clamp 500. The movement may cause curved portion 604 to move towards jaw open area 538. Curved portion 604 may thereby come into contact with corners 556 and 558 of jaws 518 and 506, respectively, at approximately the same time. In this manner, first interface element 600 may transfer the force from probe 8 along line 702 to linear clamp 500 along line 540. The force transfer process results in linear clamp 500 moving in linear direction 542A. The movement in linear direction 542A may also be assisted by the guide interface, as guide posts 302 and 304 guide linear clamp 500 along slots 508 and 520, respectively. The linear movement will disengage tack groove 4C from aperture 504 through release points 512 and 516.

It is worthy to note that pressure point 609 causing the flexing of first interface element 600 does not necessarily need to be directly opposite the jaw open area, but may be offset by a certain distance (X) and still exert sufficient pressure in the jaw open area to move linear clamp 500 along line 540 in linear direction 542A. The particular distance X may vary in accordance with certain characteristics of the interface element, such as length, mounting points and flexibility. Given the characteristics of first interface element 600, X may be approximately 0.15 inch, for example.

In one embodiment, the linear movement may release tack body 4B from aperture 504. First interface element 600 may translate the force from probe 8 along line 702 to force along line 540. The translated force moves linear clamp 500 in linear direction 542A. The linear movement causes jaws 506 and 518 to flex sufficiently to release tack groove 4C from aperture 504 through release points 512 and 516 into jaw open area 538. Tack 4 may then be lifted in a vertical direction to separate it from tag body 1A.

During linear movement of clamp body 524 as a result of the in-plane force exerted by probe 8, elongated spring arm 502 is compressed against abutment 312 at approximately point 560. Since edge 502 is out of plane with clamp body 524, end 534 moves under clamp body 524 and into recessed area 308. After tack 4 is separated from tag body 1A, probe 8 may be removed from channel 7. This disengages the probe from first interface element 600 and clamp body 524 as probe 8 is withdrawn from channel 7. The force on linear clamp 500 is thus removed and elongated spring arm 502 expands. This causes linear clamp 500 to move in linear direction 542B. Linear clamp 500 is thereby brought back to its original position via slots 508 and 520 engaging against abutments 302A and 304A, and first interface element 600 returns to its straight initial position. Linear clamp 500 may now be in the proper position for reentry of tack body 4B to attach another article to security tag 1.

The amount of linear movement for a particular implementation may vary depending upon several factors, such as the diameter of tack groove 4C, the diameter of aperture 504, the width of the jaw open area, the diameter of tack body 4B, and so forth. For example, the amount of linear movement may be slightly more than the radius of the tack groove, or approximately 0.025 inch, to release tack groove 4C into the jaw open area. In some instances, it may be desirable to have a greater amount of linear movement to ensure that tack body 4B does not substantially interfere with jaws 506 and 518 during vertical movement of tack 4, i.e., when withdrawn from tag body 1A. In one embodiment, for example, the initial position for linear clamp 500 is such that the probe at its maximum extension moves linear clamp 500 linearly between 0.045 and 0.065 inches against the bias of elongated spring arm 502, although the embodiments are not limited in this context. To accomplish this, slots 508 and 520 in conjunction with rails 302 and 304, may be constructed to not only limit linear movement of linear clamp 500 in direction 542B to define the initial position, but can also limit the linear movement of linear clamp 500 in direction 542A to provide a desired clearance for tack body 4B in jaw open area 538. It can be appreciated that this technique may also apply to all the embodiments discussed herein.

Figure 8:
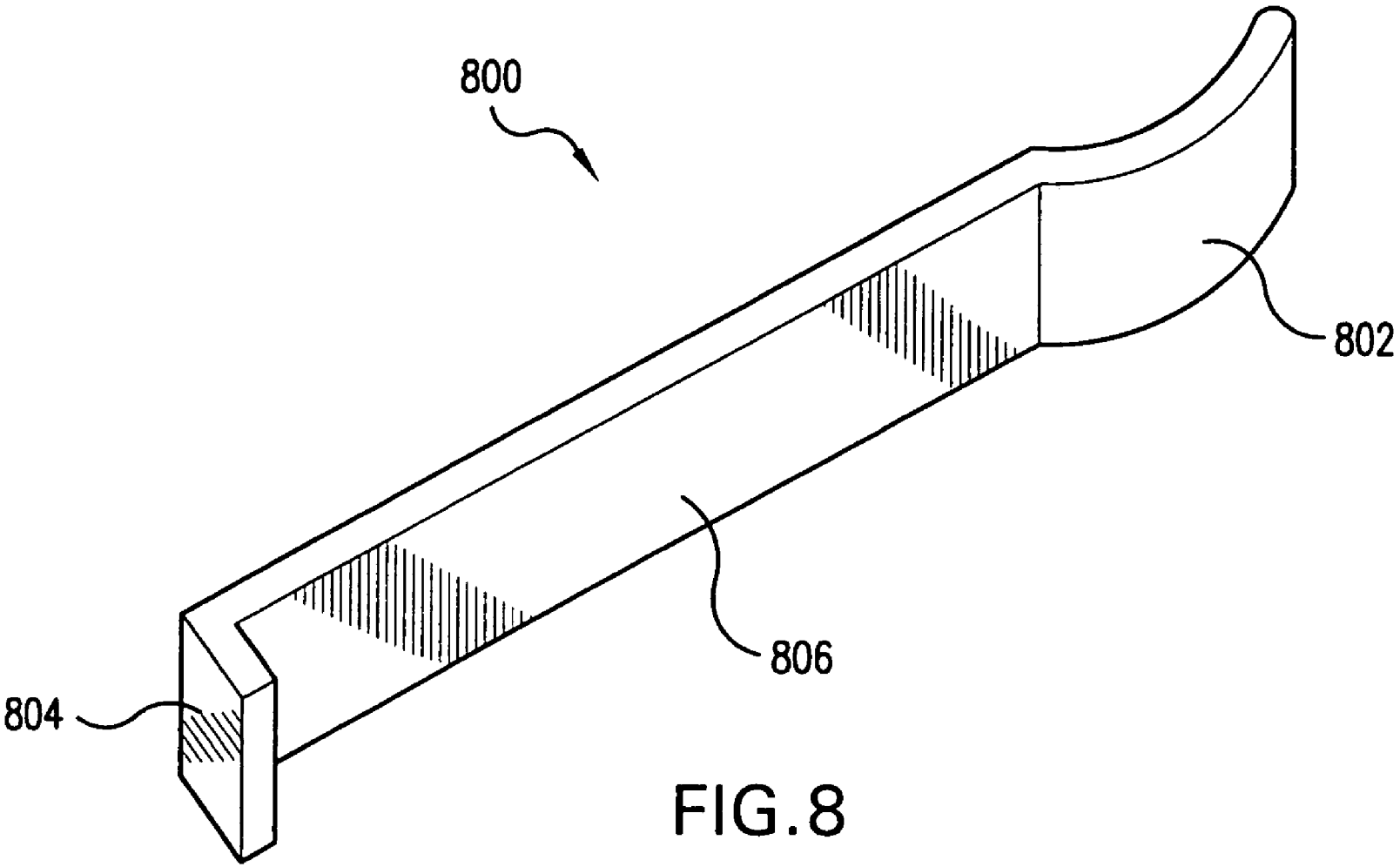
FIG. 8 illustrates a perspective view of a second interface element in accordance with one embodiment of the invention.

FIG. 8 illustrates a perspective view of a second interface element in accordance with one embodiment of the invention. FIG. 8 illustrates a second interface element 800. In one embodiment, second interface element 800 may comprise a rectangular shape piece of flat material such as steel approximately 0.2 inch high, 0.7 inch long and 0.03 inch thick. Further, it comprises a flat side 806 with a curved portion 802 and a pivot element 804. In one embodiment, pivot element 804 may be, for example, a flange. Similar to first interface element 600, second interface element 800 may be used with linear clamp 500 and similar linear clamp constraints. Unlike first interface element 600, second interface element 800 is not flexible and is mounted at one end so it swings like a gate. Second interface element 800 is discussed in more detail with reference to FIG. 9.

Figure 9:
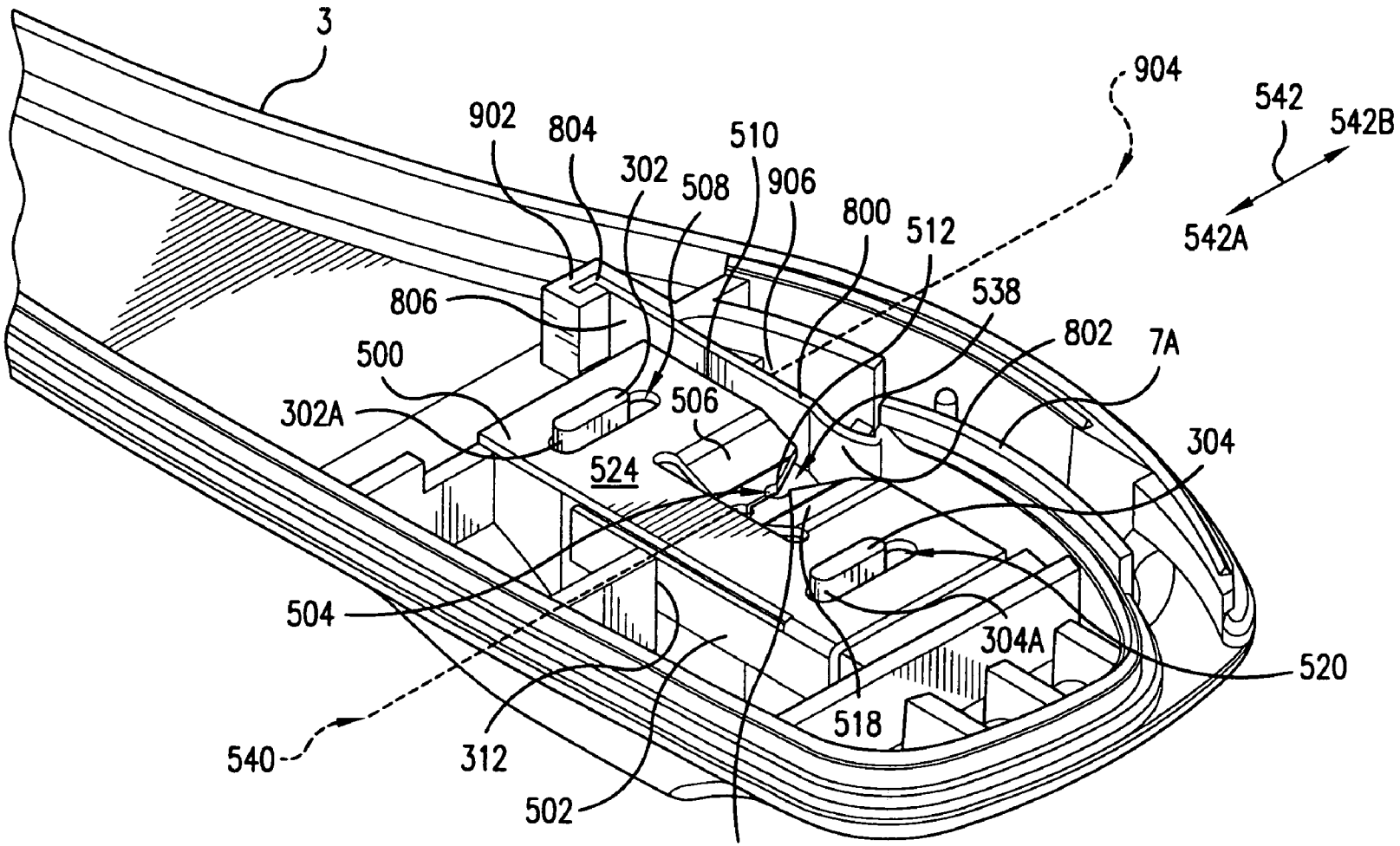
FIG. 9 illustrates a view of the interior of the lower housing of the security tag of FIG. 1 with a linear clamp and a second interface element in accordance with one embodiment of the invention.

FIG. 9 illustrates a view of the interior of the lower housing of the security tag 1 with a linear clamp and second interface element in accordance with one embodiment of the invention. FIG. 9 illustrates linear clamp 500 and second interface element 800 disposed within lower housing 3. Similar to the other interface elements, second interface element 800 may be used with linear clamp 500 and similar linear clamp constraints.

As shown in FIG. 9, second interface element 800 may be inserted into lower housing 3. More particularly, second interface element 800 may be mounted such that flat surface 806 is normal to edge 510 of linear clamp 500, and the 0.2 inch dimension is approximately centered on edge 510. End 804 of second interface element 800 may be mounted to lower housing 3 by mount 902. Second interface element 800 may pivot at the mounted end. It may pivot outside point 906 which is approximately where probe 8 makes contact with element 800 to provide force. Second interface element 800 may be constrained in all linear directions by lower housing 3 and upper housing 2, except for allowing a slight rotational movement to press against edge 510 in jaw open area 538.

When linear clamp 500 is in the initial position, second interface element 800 may be loosely between edge 510 and wall 7A. Further, second interface element 800 may be approximately parallel to edge 510. Curved portion 802 of second interface element 800 may be touching linear clamp 500, but does not necessarily apply pressure while in the initial position. Curved portion 802 may be aligned opposite jaw open area 538, and may be contoured to optimize contact with corners 556 and 558 of jaw open area 538.

In one embodiment, second interface element 800 may transfer force from probe 8 to move linear clamp 500 along line 540 in linear direction 542A. When probe 8 provides force to second interface element 800 toward edge 510 along line 904, second interface element 800 may move towards linear clamp 500. The movement may cause curved portion 802 to move into jaw open area 538 and come into contact with corners 556 and 558 of jaws 518 and 506, respectively, at approximately the same time. In this manner, second interface element 800 may transfer the force from probe 8 along line 904 to linear clamp 500 along line 540. The force transfer process may result in linear clamp 500 moving in linear direction 542A. The movement in linear direction 542A may also be assisted by the guide interface, as guide posts 302 and 304 guide linear clamp 500 along slots 508 and 520, respectively. The linear movement may disengage tack groove 4C from aperture 504 through release points 512 and 516.

As discussed previously, the amount of linear movement may vary. In one embodiment, for example, linear clamp 500 may move between 0.045 and 0.065 inches, although the embodiments are not limited in this context. When probe 8 is withdrawn, compressed elongated spring arm 502 returns linear clamp 500 back to its initial position, which in turn pushes second interface element 800 back to its initial position.

Figure 10:
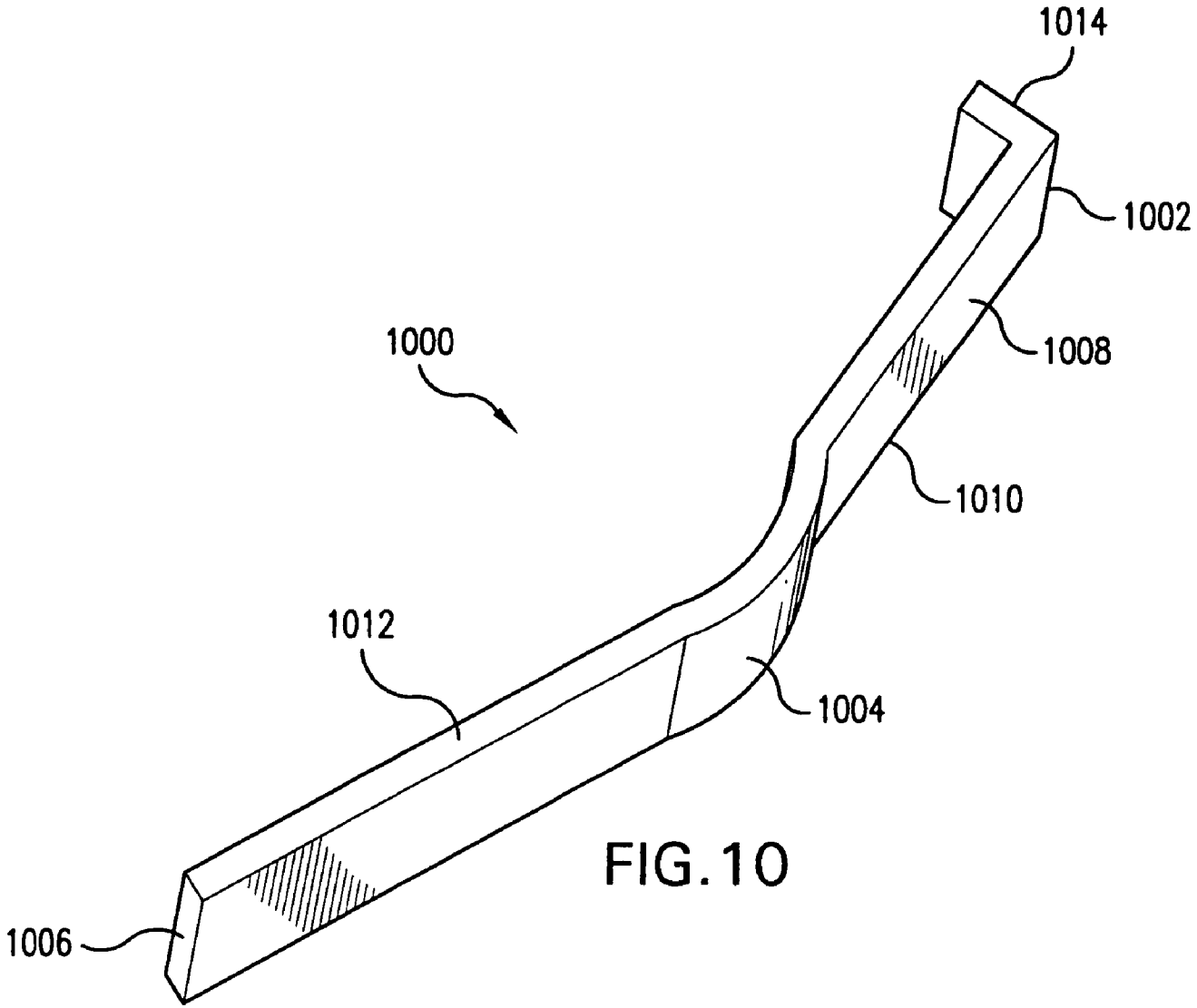
FIG. 10 illustrates a perspective view of a third interface element in accordance with one embodiment of the invention.

FIG. 10 illustrates a perspective view of a third interface element in accordance with one embodiment of the invention. FIG. 10 illustrates a third interface element 1000. In one embodiment, third interface element 1000 may be a rectangular shape piece of flat material such as steel approximately 0.2 inch high, 0.8 inch long, and 0.03 inch thick. More particularly, third interface element 1000 may comprise an end 1002 having a pivot element 1014. In one embodiment, pivot element 1014 may be, for example, a flange. Third interface element may also comprise a curved portion 1004, an end 1006, a flat surface 1008, a first portion 1010, a second portion 1012, and a flange 1014. First portion 1010 extends in a first linear direction, while second portion 1012 may extend in a second linear direction at an angle to the first linear direction. In one embodiment, the angle may be 30 degrees, although the embodiments are not limited in this context. Similar to the other interface elements, third interface element 1000 may be used with linear clamp 500 and similar linear clamp constraints. Third interface element 1000 is discussed in more detail with reference to FIG. 11.

Figure 11:
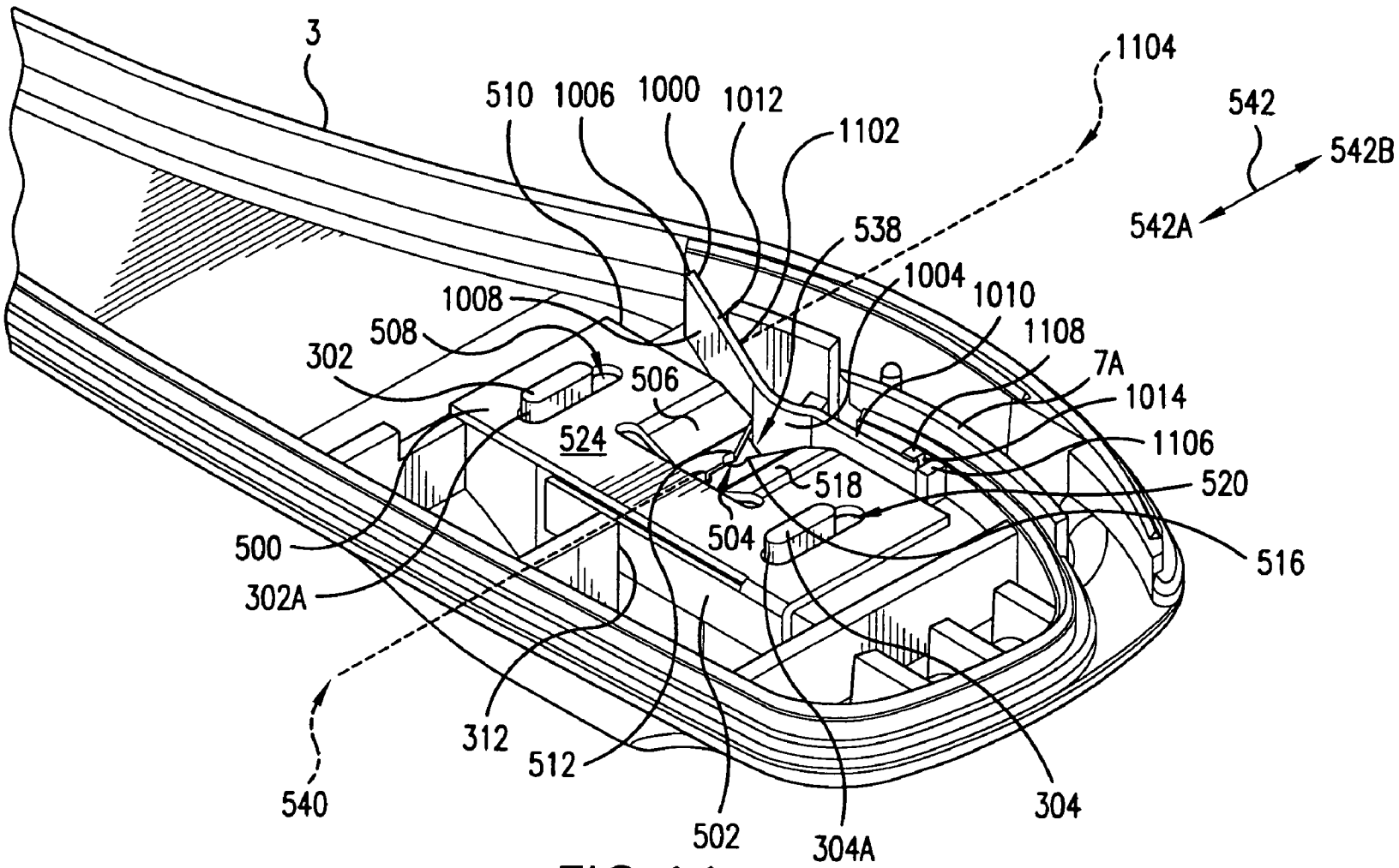
FIG. 11 illustrates a view of the interior of the lower housing of the security tag of FIG. 1 with a linear clamp and a third interface element in accordance with one embodiment of the invention.

FIG. 11 illustrates a view of the interior of the lower housing of security tag 1 with a linear clamp and a third interface element in accordance with one embodiment of the invention. FIG. 11 illustrates linear clamp 500 and third interface element 1000 disposed within lower housing 3. Similar to the other interface elements, third interface element 1000 may be used with linear clamp 500 and similar linear clamp constraints. Similar to second interface element 800, third interface element 1000 is not flexible and is mounted at only one end.

As shown in FIG. 11, third interface element 1000 may be inserted into lower housing 3. More particularly, flange 1014 of third interface element 1000 may be mounted into lower housing 3 between wall 7A and abutments 1106 and 1108. When mounted, flat surface 1008 of first portion 1010 is normal to the flat of edge 510 and the 0.2 dimension is approximately centered on edge 510. Curved portion 1004 may be opposite jaw open area 538 created by jaws 506 and 518, and may be contoured to optimize contact with corners 556 and 558 of jaws 506 and 518, respectively, at approximately the same time. Second portion 1012 may be bent away from edge 510 at approximately a 30 degree angle, and is approximately 0.3 inches from end 1006 adjacent to the jaw open area. When in the initial position, first portion 1010 is loosely between edge 510 and wall 7A. First portion 1010 may be substantially parallel to edge 510, and curved portion 1004 may be touching linear clamp 500, but does not necessarily apply any pressure in the initial position. Third interface element 1000 is constrained in all linear directions by lower housing 3 and upper housing 2, except for allowing a slight rotational movement to press against corners 556 and 558.

In one embodiment, third interface element 1000 transfers force from probe 8 to move linear clamp 500 along line 540 in linear direction 542A. During the detaching process, probe 8 makes contact with second portion 1012 at point 1102. When probe 8 applies force to second portion 1012 along line 1104, third interface element 1000 may pivot around flange 1014, bringing curved portion 1004 in contact with corners 556 and 558. In this manner, the force along line 1104 may be transferred to jaw open area 538 along line 540. The force moves linear clamp 500 along line 540 in a linear direction 542A. The linear movement may disengage tack groove 4C from aperture 504 through release points 512 and 516, and tack 4 may be removed from jaw open area 538.

As discussed previously, the amount of linear movement may vary. In one embodiment, for example, linear clamp 500 may move between 0.045 and 0.065 inches, although the embodiments are not limited in this context. When probe 8 is withdrawn, compressed elongated spring arm 502 returns linear clamp 500 back to its initial position, which in turn pushes third interface element 1000 back to its initial position.

Figure 12:
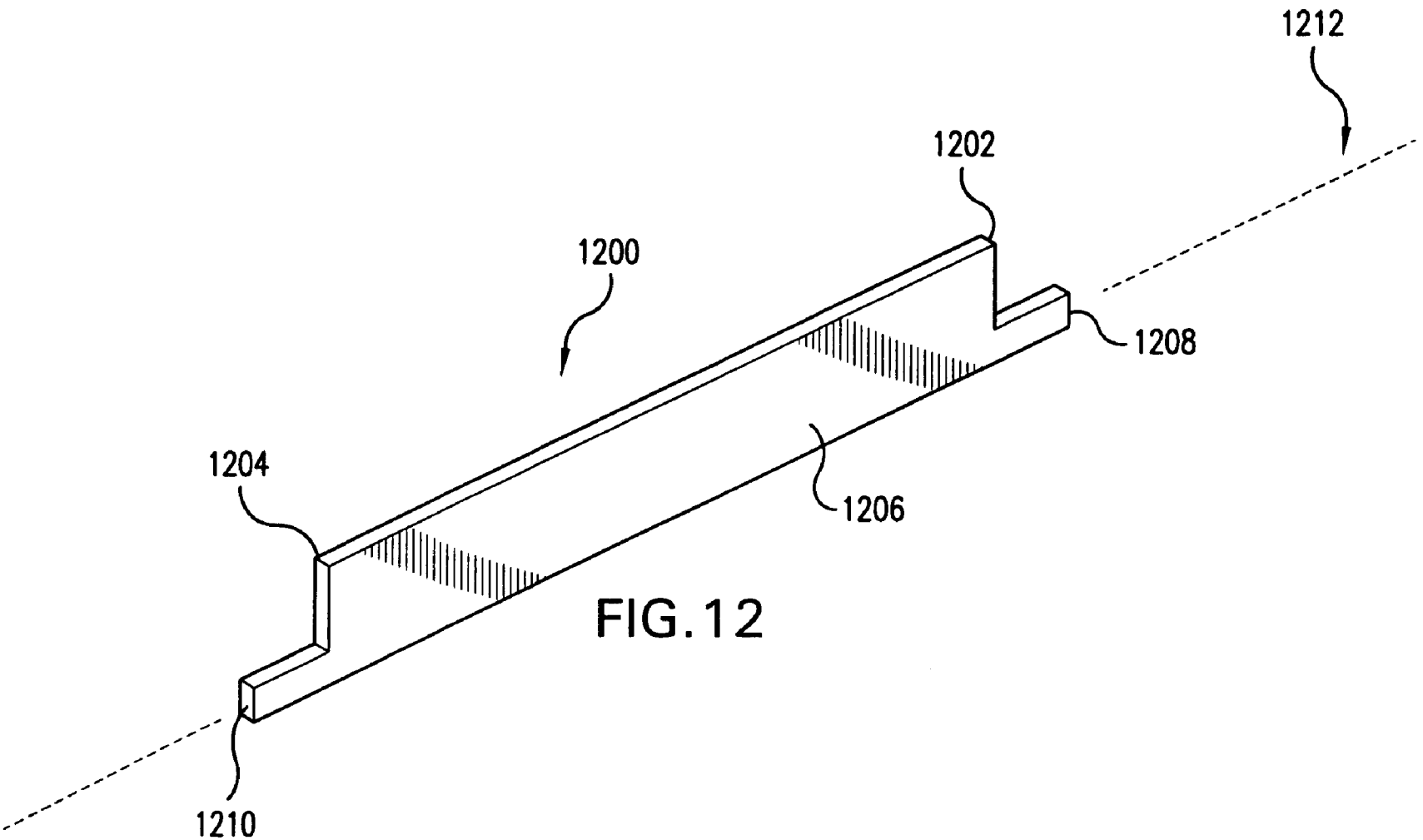
FIG. 12 illustrates a perspective view of a fourth interface element in accordance with one embodiment of the invention.

FIG. 12 illustrates a perspective view of a fourth interface element in accordance with one embodiment of the invention. FIG. 12 illustrates a fourth interface element 1200. In one embodiment, fourth interface element 1200 comprises an end 1202, an end 1204, a flat surface 1206, a hinge 1208, and a hinge 1210. Hinges 1208 and 1210 may be used to allow fourth interface element 1200 to pivot around a pivot axis 1212, for example. Fourth interface element 500 is discussed in more detail with reference to FIG. 13.

Figure 13:
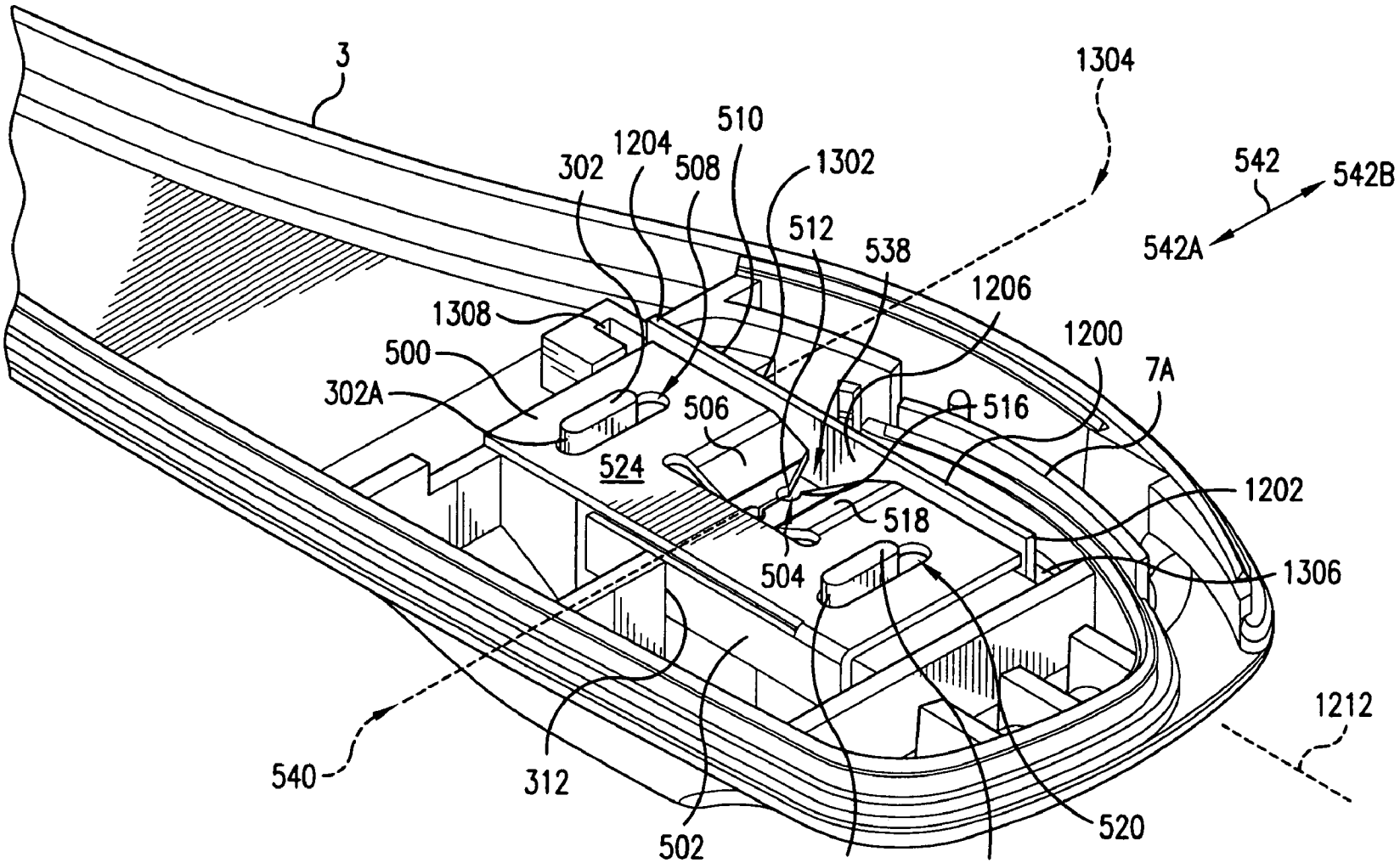
FIG. 13 illustrates a view of the interior of the lower housing of the security tag of FIG. 1 with a linear clamp and a fourth interface element in accordance with one embodiment of the invention.

FIG. 13 illustrates a view of the interior of the lower housing of the security tag 1 with a linear clamp and a fourth interface element in accordance with one embodiment of the invention. FIG. 13 illustrates linear clamp 500 and fourth interface element 1200 disposed within lower housing 3. Similar to the other interface elements, fourth interface element 1200 may be used with linear clamp 500 and similar linear clamp constraints.

Figure 12A:
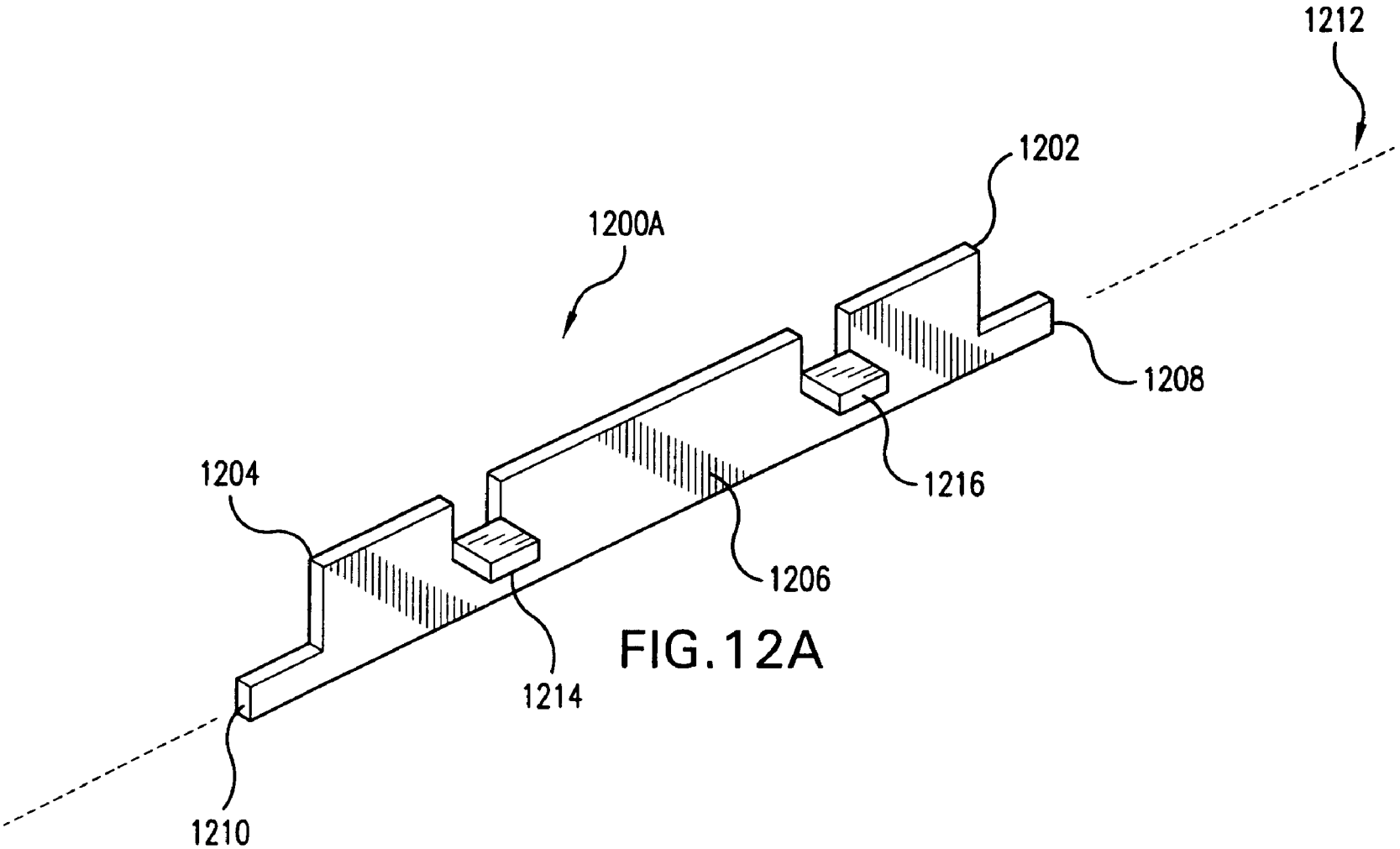
FIG. 12A illustrates a perspective view of an alternative fourth interface element in accordance with one embodiment of the invention.

As shown in FIG. 13, fourth interface element 1200 may be mounted in lower housing 3. In one embodiment, fourth interface element 1200 may be a rectangular shaped piece of flat material such as steel that pivots on a long edge with pivot axis 1212 parallel to edge 510. Fourth interface element 1200 may be 0.025 inch thick. The length may approximate the length of edge 510 although it may be longer, and may have a height of approximately 0.23 inch. Pivot axis 1212 is approximately 0.2 inches below the flat of edge 510 and approximately 0.02 inch inside the flat along edge 510. Rotation of fourth interface element 1200 about pivot axis 1212 is loosely constrained between wall 7A and edge 510. The initial position of fourth interface element 1200 may be against edge 510 along its entire length approximately 0.03 inches from the top of fourth interface element 1200. Alternatively, the initial position of fourth interface element 1200 may be against wall 7A leaving the contact line of edge 510 approximately 0.01 inch away from edge 510, for example. It can be appreciated that the initial position may also be anywhere between wall 7A and edge 510. Lateral constraint of fourth interface element 1200 may be accomplished using plastic housing mounts 1308 and 1306 of lower housing 3 to hold hinges 1210 and 1208, respectively. Vertical constraint can be accomplished by protrusions from the upper housing fitting into the lower housing loosely over hinges 1210 and 1208. Alternatively, vertical constraint of fourth interface element 1200 may be accomplished by having part of fourth interface element 1200 being under or about edge 510. This may be illustrated by flanges 1214 and 1216 as shown in FIG. 12A. In one embodiment, fourth interface element 1200 should be able to pivot from the abutment to approximately 0.065 inch beyond initial position of edge 510, for example.

In one embodiment, fourth interface element 1200 transfers force from probe 8 to move linear clamp 500 along line 540 in linear direction 542A. During the detachment process, probe 8 may make contact with fourth interface element 1200 at point 1302. Probe 8 may provide force at point 1302 along line 1304 causing it to pivot along pivot axis 1212 and contact edge 510. Further movement of probe 8 may push fourth interface element 1200 uniformly against edge 510, thereby moving linear clamp 500 in linear direction 542A. In this manner, fourth interface element 1200 may transfer force along line 1304 to line 540. The force moves linear clamp 500 along line 540 in a linear direction 542A. The linear movement may disengage tack body 4B from aperture 504 through release points 512 and 516, and tack 4 may be removed from jaw open area 538.

As discussed previously, the amount of linear movement may vary. In one embodiment, for example, linear clamp 500 may move between 0.045 and 0.065 inches, although the embodiments are not limited in this context. When probe 8 is withdrawn, compressed elongated spring arm 502 returns linear clamp 500 back to its initial position, which in turn pushes fourth interface element 1200 back to its initial position.

Figure 14:
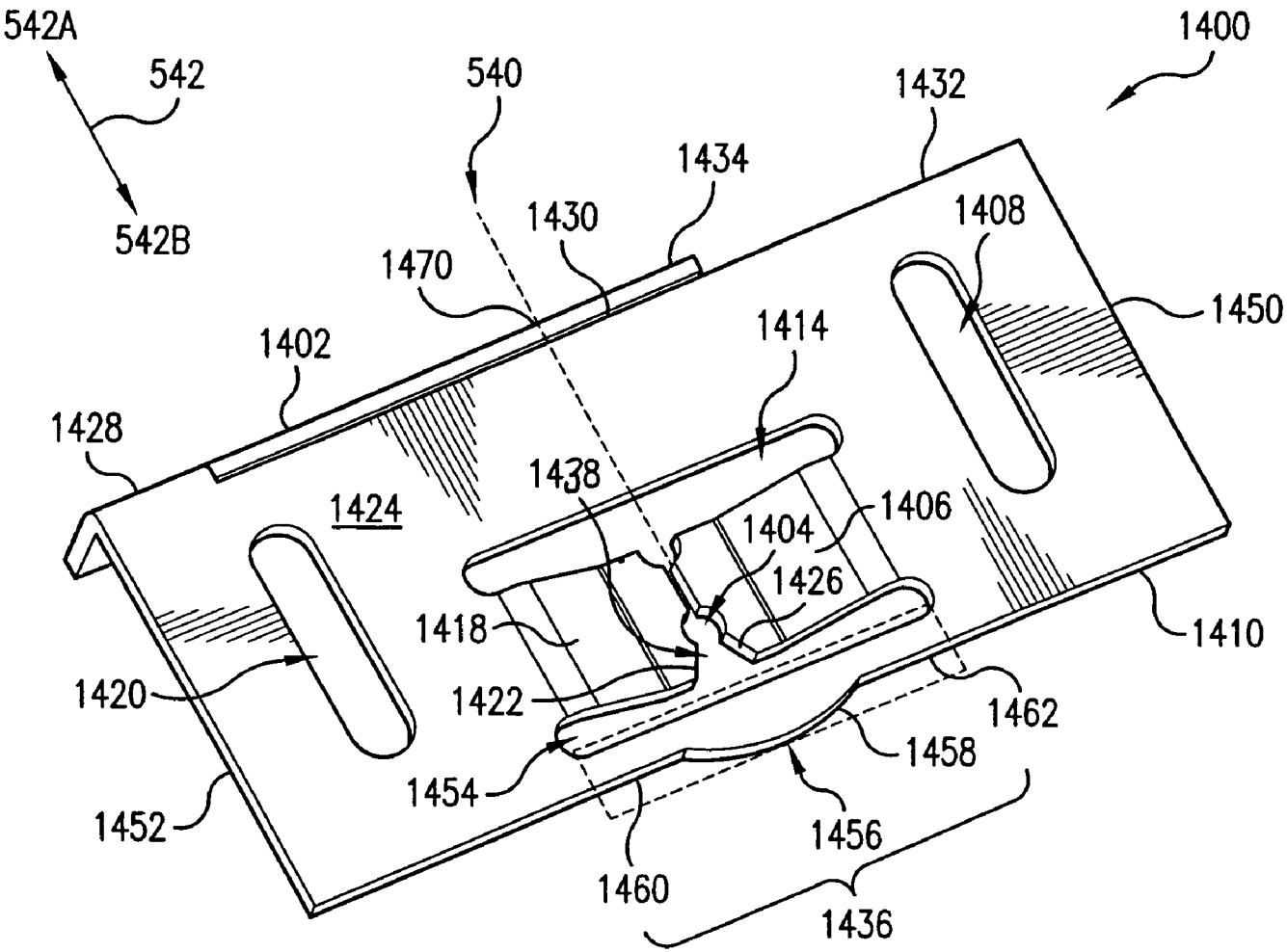
FIG. 14 illustrates an exploded view of a second linear clamp used in the security tag of FIG. 1 in accordance with one embodiment of the invention.

FIG. 14 illustrates an exploded view of a second linear clamp used in the security tag of FIG. 1 in accordance with one embodiment of the invention. FIG. 14 illustrates a second linear clamp 1400. Second linear clamp 1400 is similar in structure, constraints, supports, positioning and operation as first linear clamp 500. More particularly, elements 502, 504, 506, 508, 510, 512, 514, 516, 518, 520, 522, 524, 526, 528, 530, 532, 534, 538, 540, 542, 550 and 552, substantially correspond to elements 1402, 1404, 1406, 1408, 1410, 1412, 1414, 1416, 1418, 1420, 1422, 1424, 1426, 1428, 1430, 1432, 1434, 1438, 1440, 1442, 1450 and 1452, respectively.

In one embodiment, second linear clamp 1400 may also include a tack retaining body 1436. Tack retaining body may further comprise a bridge. The bridge may be a section of material placed across jaw open area 1438. The bridge may be implemented in a number of ways to obtain sufficient jaw open area size and bridge strength for a given application. The particular bridge solution may vary depending upon a number of factors, such as the distance between the jaws, the jaw open area, the type and flexibility of the material, contact surface of the probe, shape of the bridge, and so forth. The shape of the bridge may be, for example, any desired shape, such as straight, contoured, concave, convex, and so forth. The jaw open area should be large enough not to interfere with tack body 4B when probe 8 is at maximum extension. This has the advantage of assuring substantially one point of contact with any added interface elements and the bridge. The point of contact may be along line 540, or approximately the center of the bridge.

In one embodiment, for example, the bridge may be divided into two bridge pieces, with each piece attached to each jaw at one end, and having spaced facing edges at the other end. This may result in the bridge having a narrow gap through its center, perpendicular to slot 1414 along line 540.

In one embodiment, tack retaining body 1436 may further comprise a bridge 1456. Bridge 1456 may be a solid piece of material as shown in FIG. 14. Bridge 1456 may comprise a pair of straight portions 1460 and 1462 running parallel to slot 1414. Bridge 1456 may further comprise a curved portion 1458. Curved portion 1458 may extend away from jaw open area 1438, for example. Straight portions 1460 and 1462, combined with curved portion 1458, may form a slot 1454. Slot 1454 may be approximately parallel to, for example, slot 1414.

In one embodiment, curved portion 1458 may be adjusted to optimize contact with a contact surface of a structure providing force to linear clamp 1400. For example, the structure may be end 8A of probe 8. In another example, the structure may be an interface element. It can be appreciated that second linear clamp 1400 may be used with security tag 1 and any of the interface elements disclosed herein. With some interface elements, bridge 1456 may need to be modified to ensure optimal contact between the interface element and linear clamp 1400, as well as ensure that the amount of linear movement fits within the desired design constraints.

Figure 15:
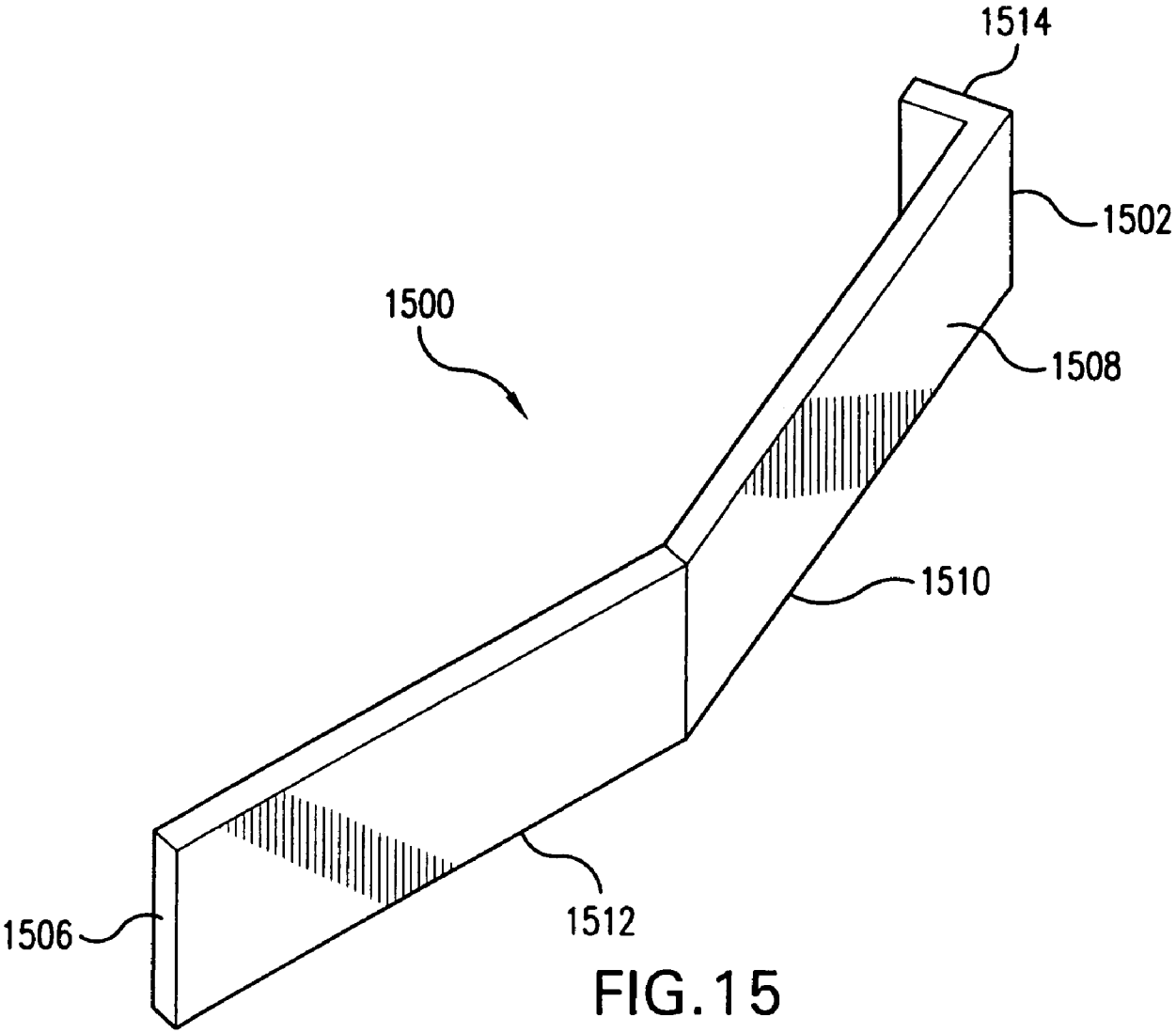
FIG. 15 illustrates a perspective view of a fifth interface element in accordance with one embodiment of the invention.

FIG. 15 illustrates a perspective view of a fifth interface element in accordance with one embodiment of the invention. FIG. 15 illustrates a fifth interface element 1500. Fifth interface element 1500 may be similar to, for example, third interface element 1000. Unlike third interface element 1000, however, fifth interface element 1500 does not have a curved portion 1004. The function of curved portion 1004 may be performed by bridge 1456, for example.

In one embodiment, fifth interface element 1500 may be a rectangular shape piece of flat material such as steel approximately 0.2 inch high, 0.8 inch long, and 0.03 inch thick. More particularly, fifth interface element 1500 may comprise an end 1502 having a pivot element 1514. In one embodiment, pivot element 1514 may be, for example, a flange. Fifth interface element 1500 may further comprise an end 1506, a flat surface 1508, a first portion 1510, a second portion 1512, and a flange 1514. First portion 1510 extends in a first linear direction, while second portion 1512 may extend in a second linear direction at an angle to the first linear direction. In one embodiment, the angle may be 30 degrees, although the embodiments are not limited in this context. Similar to the other interface elements, fifth interface element 1500 may be used with linear clamp 1400 and similar linear clamp constraints. Fifth interface element 1500 is discussed in more detail with reference to FIG. 16.

Figure 16:
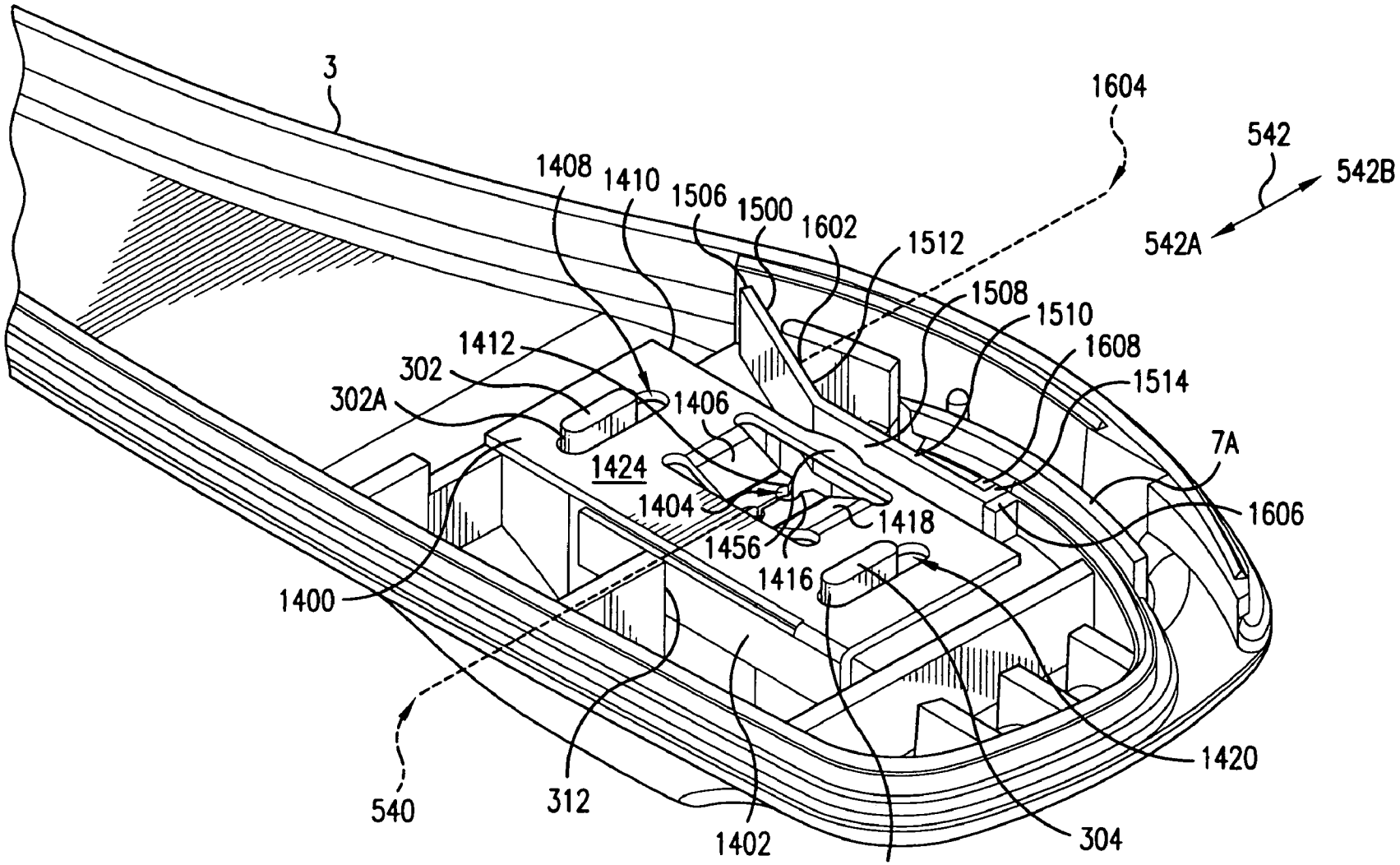
FIG. 16 illustrates a partial view of the interior of the lower housing of the security tag of FIG. 1 with a second linear clamp and a fifth interface element in accordance with one embodiment of the invention.

FIG. 16 illustrates a view of the interior of the lower housing of security tag 1 with a second linear clamp and a fifth interface element in accordance with one embodiment of the invention. FIG. 16 illustrates linear clamp 1400 and fifth interface element 1500 disposed within lower housing 3. Fifth interface element 1500 may be used with linear clamp 1400 and similar linear clamp constraints as discussed with reference to linear clamp 500. Similar to third interface element 1000, fifth interface element 1500 is not flexible and is mounted at only one end.

As shown in FIG. 16, fifth interface element 1500 may be inserted into lower housing 3. More particularly, flange 1514 of fifth interface element 1500 may be mounted into lower housing 3 between wall 7A and abutments 1606 and 1608. When mounted, flat surface 1508 of first portion 1510 is normal to the flat of edge 1410 and the 0.2 dimension is approximately centered on edge 1410. Curved portion 1458 of bridge 1456 may also make contact with flat surface 1508 of first portion 1510. Curved portion 1458 may be contoured to optimize contact with flat surface 1508 during the force transfer process. Second portion 1512 may be bent away from edge 1410 at approximately a 30 degree angle, and is approximately 0.3 inches from end 1506 adjacent to the jaw open area. When in the initial position, first portion 1510 is loosely between edge 1410 and wall 7A. First portion 1510 is substantially parallel to edge 1410, and may be touching bridge 1456, but does not necessarily apply any pressure in the initial position. Fifth interface element 1500 is constrained in all linear directions by lower housing 3 and upper housing 2, except for allowing a slight rotational movement to press against curved portion 1458 of bridge 1456.

In one embodiment, fifth interface element 1500 transfers force from probe 8 to move linear clamp 1400 along line 540 in linear direction 542A. During the detaching process, probe 8 makes contact with second portion 1512 at point 1602. When probe 8 applies force to second portion 1512 along line 1604, fifth interface element 1500 may pivot around flange 1514, bringing flat surface 1508 in contact with curved portion 1458 of bridge 1456. In this manner, the force along line 1604 may be transferred to linear clamp 1400 along line 540. The force moves linear clamp 1400 along line 540 in a linear direction 542A. The linear movement may disengage tack groove 4C from aperture 1404 through release points 1412 and 1416, and tack 4 may be removed from jaw open area 1438.

As discussed previously, the amount of linear movement may vary. In one embodiment, for example, linear clamp 1400 may move between 0.045 and 0.065 inches, although the embodiments are not limited in this context. When probe 8 is withdrawn, compressed elongated spring arm 1402 returns linear clamp 1400 back to its initial position, which in turn pushes fifth interface element 1500 back to its initial position.

Figure 17:
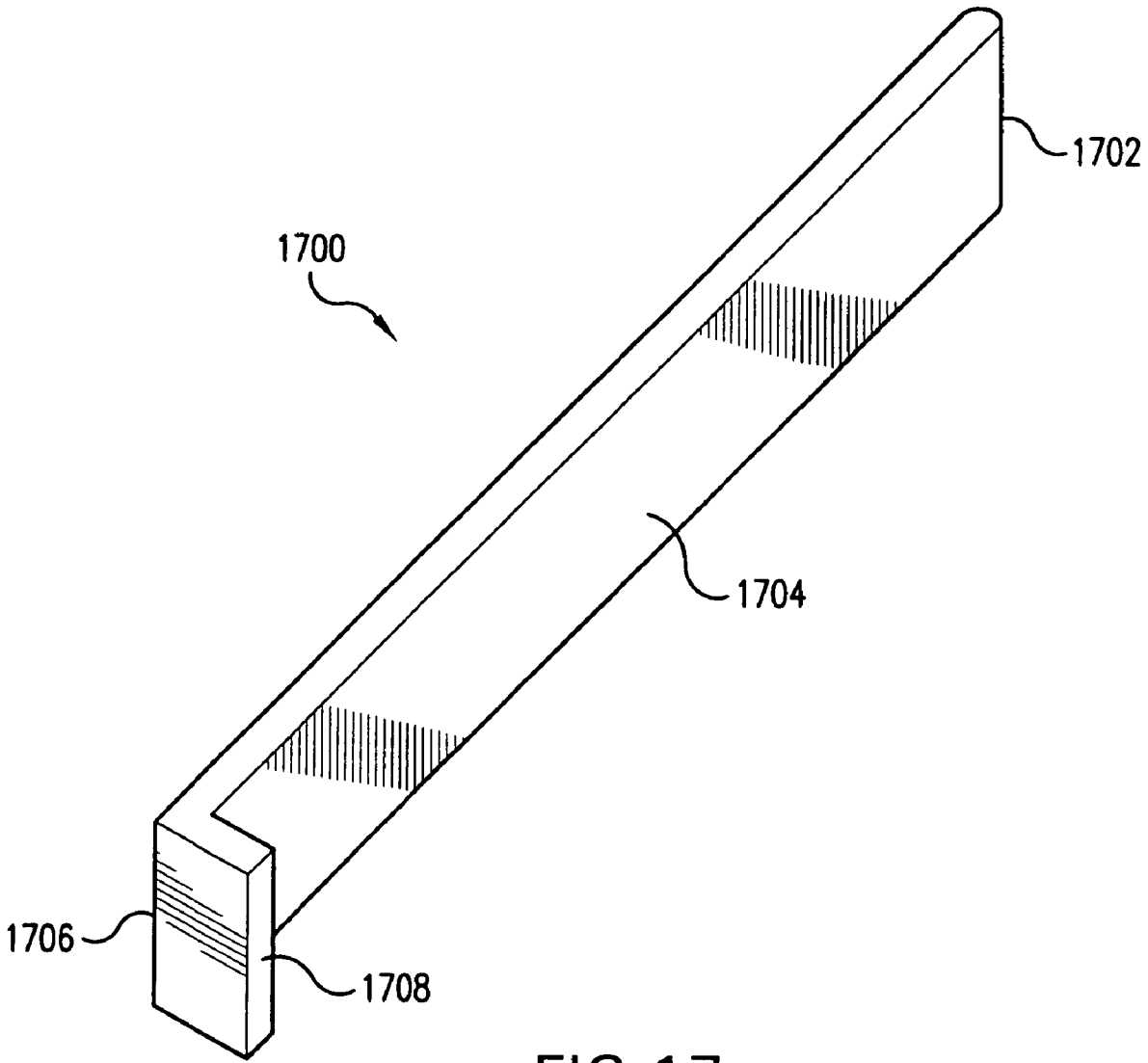
FIG. 17 illustrates a perspective view of a sixth interface element in accordance with one embodiment of the invention.

FIG. 17 illustrates a perspective view of a sixth interface element in accordance with one embodiment of the invention. FIG. 17 illustrates a sixth interface element 1700. Sixth interface element 1700 may be similar to, for example, second interface element 800. Unlike second interface element 800, however, sixth interface element 1700 does not have a curved portion 802. The function of curved portion 802 may be performed by bridge 1456, for example.

In one embodiment, sixth interface element 1700 may comprise a rectangular shape piece of flat material such as steel approximately 0.2 inch high, 0.7 inch long and 0.03 inch thick. Further, it comprises a flat side 1704 with ends 1702 and 1706. End 1706 may further comprise a pivot element 1708. In one embodiment, pivot element 1708 may be, for example, a flange. Sixth interface element 1700 is not flexible and is mounted at one end so it swings like a gate. Sixth interface element 1700 is discussed in more detail with reference to FIG. 18.

Figure 18:
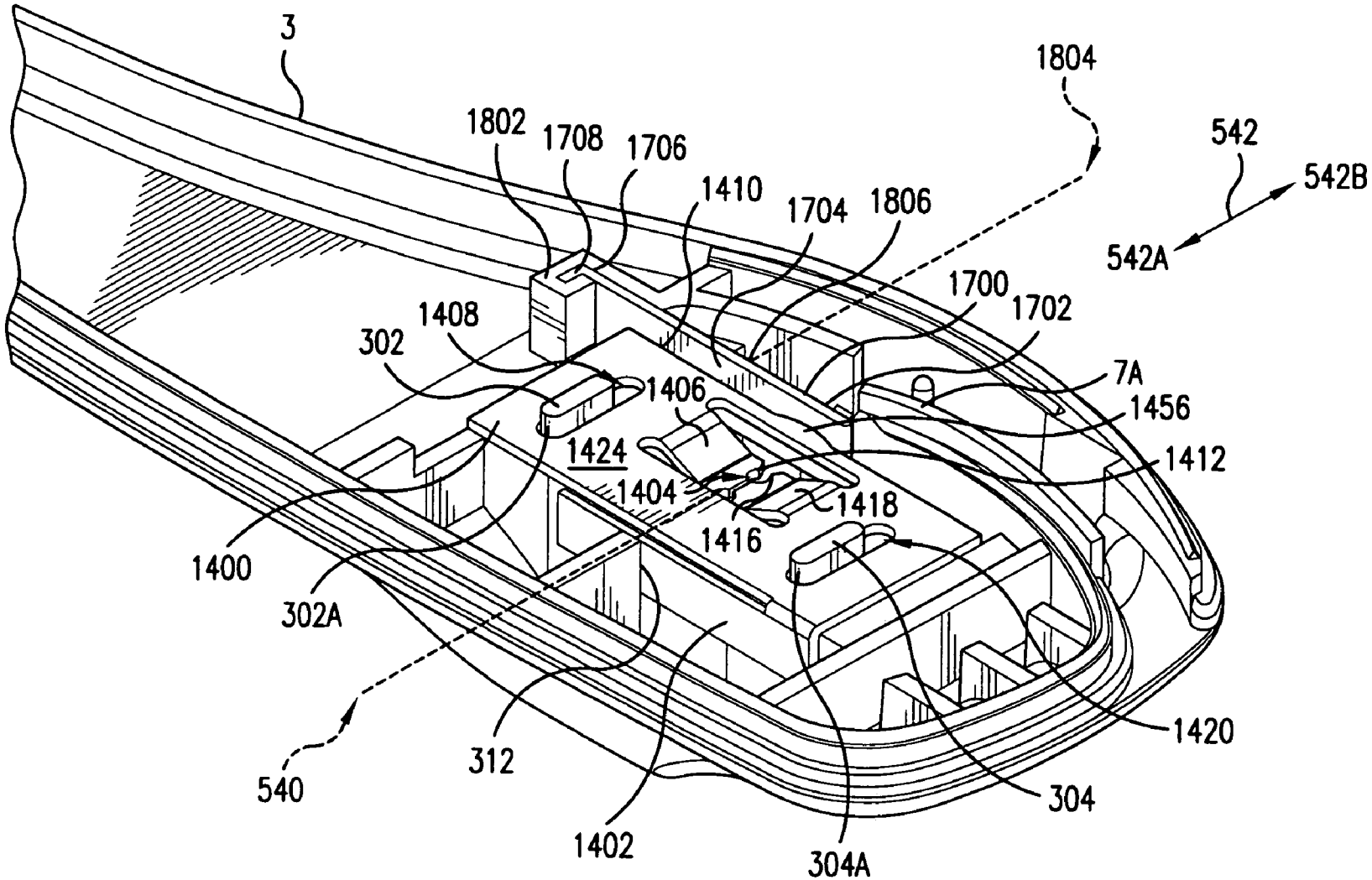
FIG. 18 illustrates a partial view of the interior of the lower housing of the security tag of FIG. 1 with a second linear clamp and a sixth interface element in accordance with one embodiment of the invention.

FIG. 18 illustrates a view of the interior of the lower housing of the security tag 1 with a second linear clamp and sixth interface element in accordance with one embodiment of the invention. FIG. 18 illustrates linear clamp 1400 and sixth interface element 1700 disposed within lower housing 3. Similar to the other interface elements, sixth interface element 1700 may be used with linear clamp 1400 and similar linear clamp constraints.

As shown in FIG. 18, sixth interface element 1700 may be inserted into lower housing 3. More particularly, sixth interface element 1700 may be mounted such that flat surface 1704 is normal to edge 1410 of linear clamp 1400, and the 0.2 inch dimension is approximately centered on edge 1410. Flange 1708 of end 1706 may be mounted to lower housing 3 by mount 1802. Sixth interface element 1700 may pivot at the mounted end. Sixth interface element 1700 may be constrained in all linear directions by lower housing 3 and upper housing 2, except for allowing a slight rotational movement to press outside surface 1704 against curved portion 1458 of bridge 1456.

When linear clamp 1400 is in the initial position, sixth interface element 1700 may be loosely between bridge 1456 and wall 7A. Further, sixth interface element 1700 may be approximately parallel to edge 1410 and may be touching bridge 1456, but does not necessarily apply pressure while in the initial position. End 1702 may be aligned opposite curved portion 1458, which may be contoured to optimize contact with surface 1704 during the force translation process.

In one embodiment, sixth interface element 1700 may transfer force from probe 8 to move linear clamp 1400 along line 540 in linear direction 542A. When probe 8 provides force to sixth interface element 1700 toward edge 1410 along line 1804, sixth interface element 1700 may transfer the force to bridge 1456. The transfer may provide resultant force along line 540, thereby pushing linear clamp 1400 in linear direction 542A. The linear movement may disengage tack groove 4C from aperture 1404 through release points 1412 and 1416.

As discussed previously, the amount of linear movement may vary. In one embodiment, for example, linear clamp 1400 may move between 0.045 and 0.065 inches, although the embodiments are not limited in this context. When probe 8 is withdrawn, compressed elongated spring arm 1402 returns linear clamp 1400 back to its initial position, which in turn pushes sixth interface element 1700 back to its initial position.

Figure 19:
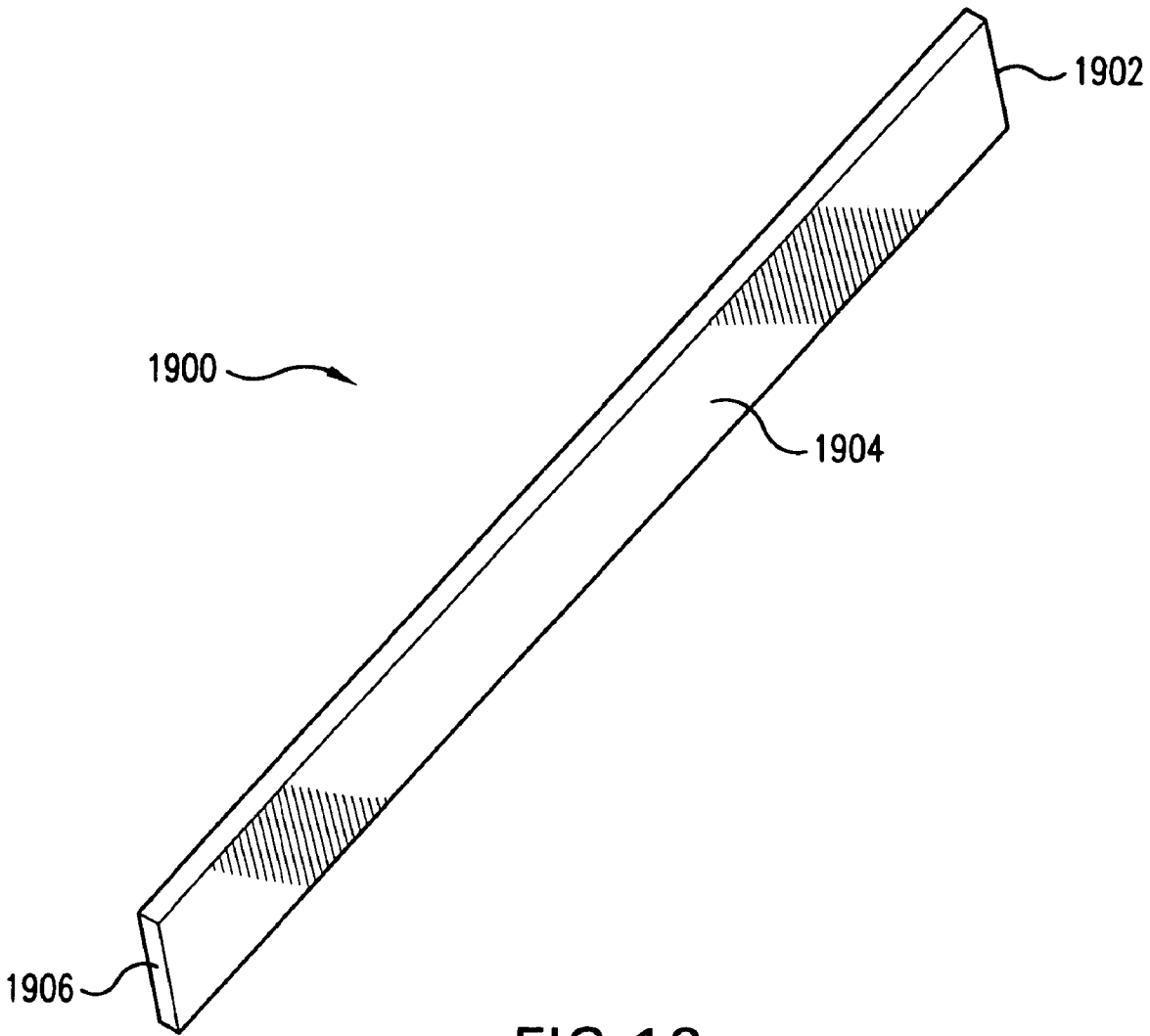
FIG. 19 illustrates a perspective view of a seventh interface element in accordance with one embodiment of the invention.

FIG. 19 illustrates a perspective view for a seventh interface element in accordance with one embodiment of the invention. FIG. 19 illustrates a seventh interface element 1900. Seventh interface element 1900 may be similar to, for example, first interface element 600. Unlike first interface element 600, however, seventh interface element 1900 does not have a curved portion 604. The function performed by curved portion 604 may be performed by bridge 1456.

In one embodiment, seventh interface element 1900 comprises a flexible rectangular flat spring steel shaped similarly to elongated spring arm 1402. Further, it comprises a flat side 1904 with ends 1902 and 1906. In one embodiment, seventh interface element 1900 may be approximately one inch long, 0.2 inch high and 0.015 inch thick, although the embodiments are not limited in this context.

In one embodiment, seventh interface element 1900 may be used to assist the translation of force from probe 8 to linear clamp 1400. The translated force may assist linear clamp 1400 to move in linear direction 542A during the process of releasing security clamp 1 from article 51. Seventh interface element 1900 may be discussed in more detail with reference to FIG. 20.

Figure 20:
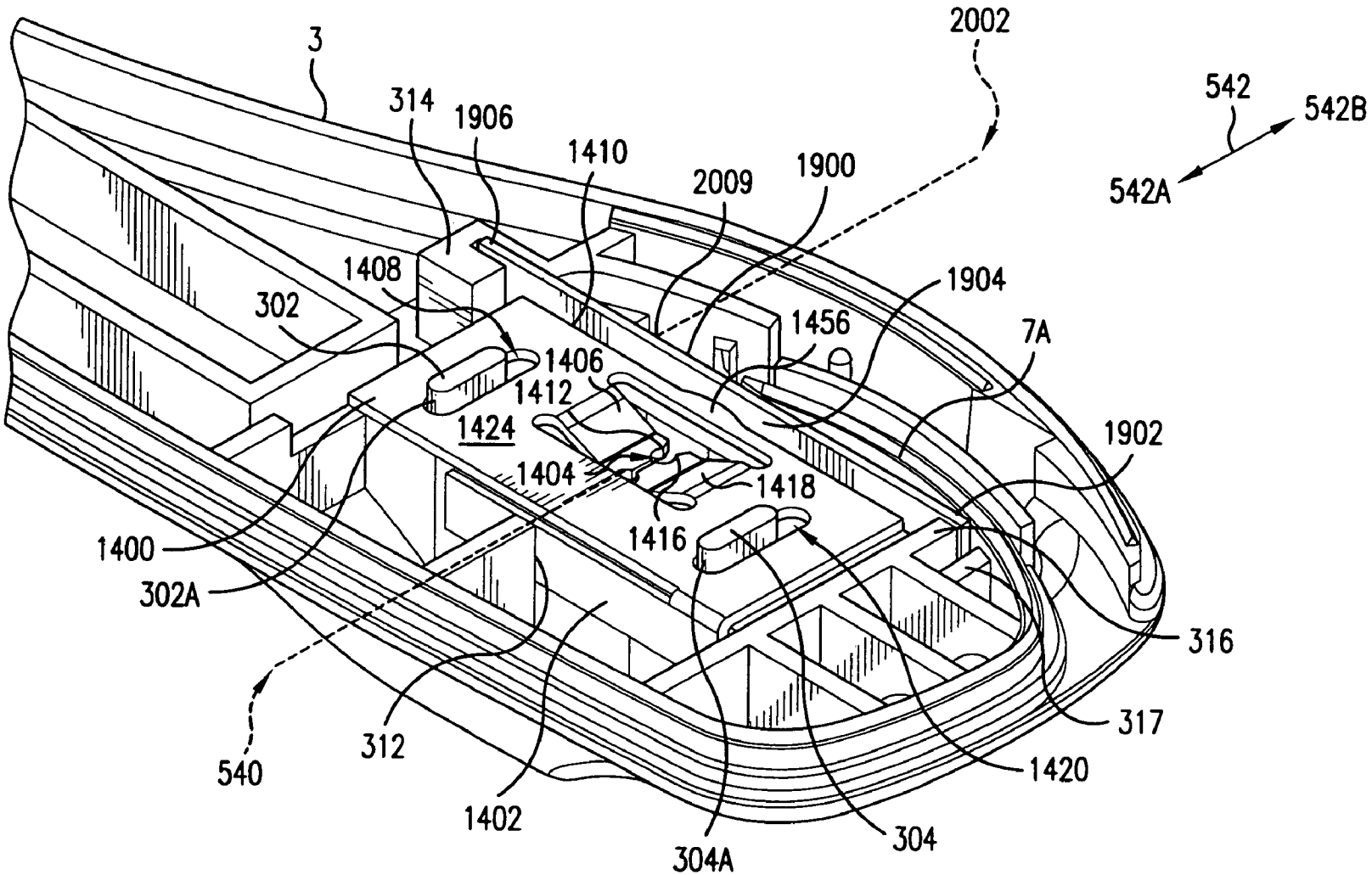
FIG. 20 illustrates a partial view of the interior of the lower housing of the security tag of FIG. 1 with a second linear clamp and a seventh interface element in accordance with one embodiment of the invention.

FIG. 20 illustrates a view of the interior of the lower housing of security tag 1 with a second linear clamp and seventh interface element in accordance with one embodiment of the invention. FIG. 20 illustrates linear clamp 1400 and seventh interface element 1900 as disposed within lower housing 3. Linear clamp 1400 and seventh interface element 1900 are disposed within lower housing 3 to facilitate movement of linear clamp 1400 in linear direction 542A in response to an external force, such as generated by probe 8, for example.

As shown in FIG. 20, seventh interface element 1900 may be inserted into lower housing 3. End 1906 may be loosely inserted into mount 314, and end 1902 may be loosely inserted into a slot formed by walls 316 and 7A, and abutment 317, as shown. The mounting locates surface 1904 against or nearly against center of bridge 1456 such that surface 1904 is normal to edge 1410 and the 0.2 inch dimension of surface 1904 is approximately centered on edge 1410. The mounting may constrain seventh interface element 1900 in all linear directions except for allowing it to bow or flex against bridge 1456. It may be appreciated that the mounts for seventh interface element 1900 may be placed in other areas of lower housing 3 and still fall within the scope of the invention.

In one embodiment, seventh interface element 1900 transfers force from probe 8 to move linear clamp 1400 along line 540 in linear direction 542A. Probe 8 may contact seventh interface element 1900 at approximately point 2009 and provide force along line 2002. This may cause seventh interface element 1900 to bow towards curved portion 1458 of bridge 1456. Surface 1904 may make contact with bridge 1456 and provide resultant force along line 540, which moves linear clamp 1400 on the guide interface in linear direction 542A.

In one embodiment, the linear movement may release tack body 4B from aperture 1404. Seventh interface element 1900 may translate the force from probe 8 along line 2002 to force along line 540. The translated force moves linear clamp 1400 in linear direction 542A. The linear movement causes jaws 1406 and 1418 to flex sufficiently to release tack groove 4C from aperture 1404 through release points 1412 and 1416 into jaw open area 1438. Tack 4 may then be lifted in a vertical direction to separate it from tag body 1A.

As discussed previously, the amount of linear movement may vary. In one embodiment, for example, linear clamp 1400 may move between 0.045 and 0.065 inches, although the embodiments are not limited in this context. When probe 8 is withdrawn, compressed elongated spring arm 1402 returns linear clamp 1400 back to its initial position, which in turn pushes seventh interface element 1900 back to its initial position.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. A security tag, comprising:

a tag housing;

a tack body; and a linear clamp disposed within said tag housing to retain said tack body, said linear clamp to move in a substantially linear direction in response to force to release said tack body from said linear clamp, said linear clamp to comprise:

a clamp body having a slot at each end of said body;

a spring arm attached to a first edge of said clamp body; and a tack retaining body to retain said tack body, said tack retaining body to comprise a first jaw and a second jaw, with each jaw terminating in spaced facing edges, said spaced facing edges forming an aperture and a law open area in said clamp body, and a second portion of said spaced facing edges are straight to form said jaw open area, with a first distance between a first end of said jaw open area being less than a second distance between a second end of said jaw open area.

2. A security tag, comprising:
a tag housing;
a tack body; and
a linear clamp disposed within said tag housing to retain said tack body, said linear clamp to move in a substantially linear direction in response to force to release said tack body from said linear clamp, said linear clamp to comprise:
a clamp body having a slot at each end of said body, with each slot substantially perpendicular to a first plane of said clamp body, and substantially parallel to each other in said linear direction;
a spring arm attached to a first edge of said clamp body; and
a tack retaining body to retain said tack body.

3. The security tag of claim 2, wherein said tag housing comprises a top half and a bottom half, and said bottom half includes a set of guide rails corresponding to said slots to receive said slots and allow movement in said linear direction.

4. A security tag, comprising:
a tag housing;
a tack body; and
a linear clamp disposed within said tag housing to retain said tack body, said linear clamp to move in a substantially linear direction in response to force to release said tack body from said linear clamp, said linear clamp to comprise:
a clamp body having a slot at each end of said body; a spring arm attached to a first edge of said clamp body, said spring arm to comprises a spring arm body that extends along a first edge of said clamp body, and a curved joint joining said spring arm body to one end of said clamp body; and
a tack retaining body to retain said tack body.

5. A security tag, comprising:
a tag housing;
a tack body; and
a linear clamp disposed within said tag housing to retain said tack body, said linear clamp to move in a substantially linear direction in response to force to release said tack body from said linear clamp, said linear clamp to comprise:
a clamp body having a slot at each end of said body;
a spring arm attached to a first edge of said clamp body;
a tack retaining body to retain said tack body, said tack retaining body to comprise a first jaw and a second jaw, with each jaw terminating in spaced facing edges, said spaced facing edges forming an aperture and a jaw open area in said clamp body, and
said linear clamp further comprising a first interface element to assist moving said linear clamp in said linear direction.

6. The security tag of claim 5, wherein said linear clamp body includes a second edge that is substantially flat.

7. The security tag of claim 6, wherein said first interface element comprises a first side that is substantially flat with a curved portion integrally formed thereon, said first interface element being disposed within said tag body so that said first side is normal to said second edge and said curved portion corresponds to said jaw open area, with said first interface element being constrained by said tag body except for movement from a first position to a second position against said second edge in response to said force.

8. The security tag of claim 7, wherein said first interface element receives force and moves from said first position to said second position toward said second edge to contact said curved portion across said jaw open area thereby moving said linear clamp in said linear direction.

9. The security tag of claim 8, wherein said first interface element moves from said second position to said first position when said force is terminated.

10. A security tag, comprising:
a tag housing;
a tack body; and
a linear clamp disposed within said tag housing to retain said tack body, said linear clamp to move in a substantially linear direction in response to force to release said tack body from said linear clamp, said linear clamp to comprise:
a clamp body having a slot at each end of said body;
a spring arm attached to a first edge of said clamp body;
a tack retaining body to retain said tack body, said tack retaining body to comprise a first jaw and a second jaw, with each jaw terminating in spaced facing edges, said spaced facing edges forming an aperture and a jaw open area in said clamp body, and
said linear clamp further comprising a second interface element to assist moving said linear clamp in said linear direction.

11. The security tag of claim 10, wherein said linear clamp body includes a second edge that is substantially flat.

12. The security tag of claim 11, wherein said second interface element comprises a first side that is substantially flat with a curved portion integrally formed at a first end and a pivot element at a second end, said second interface element being disposed within said tag body so that said first side is normal to said second edge and said curved portion corresponds to said jaw open area, with said second interface element being constrained by said tag body except for movement from a first position to a second position against said second edge in response to said force.

13. The security tag of claim 12, wherein said second interface element receives force and moves from said first position to said second position toward said second edge to contact said curved portion across said jaw open area thereby moving said linear clamp in said linear direction.

14. The security tag of claim 13, wherein said second interface element moves from said second position to said first position when said force is terminated.

15. A security tag, comprising:
a tag housing;
a tack body; and
a linear clamp disposed within said tag housing to retain said tack body, said linear clamp to move in a substantially linear direction in response to force to release said tack body from said linear clamp, said linear clamp to comprise:
a clamp body having a slot at each end of said body;
a spring arm attached to a first edge of said clamp body;
a tack retaining body to retain said tack body, said tack retaining body to comprise a first jaw and a second jaw, with each jaw terminating in spaced facing edges, said spaced facing edges forming an aperture and a jaw open area in said clamp body, and
said linear clamp further comprising a third interface element to assist moving said linear clamp in said linear direction.

16. The security tag of claim 15, wherein said linear clamp body includes a second edge that is substantially flat.

17. The security tag of claim 16, wherein said third interface element comprises a first side that is substantially flat, said third interface element having a first section and a second section with a curved portion between said sections, said third interface element being disposed within said tag body so that said first section is normal to said second edge, said curved portion corresponds to said jaw open area, and said second section forms an angle with said second edge, with said third interface element being constrained by said tag body except for movement from a first position to a second position against said second edge in response to said force.

18. The security tag of claim 17, wherein said third interface element receives force and moves from said first position to said second position toward said second edge to contact said curved portion across said jaw open area thereby moving said linear clamp in said linear direction.

19. The security tag of claim 18, wherein said third interface element moves from said second position to said first position when said force is terminated.

20. A security tag, comprising:

a tag housing;

a tack body; and a linear clamp disposed within said tag housing to retain said tack body, said linear clamp to move in a substantially linear direction in response to force to release said tack body from said linear clamp, said linear clamp to comprise:

a clamp body having a slot at each end of said body;

a spring arm attached to a first edge of said clamp body;

a tack retaining body to retain said tack body, said tack retaining body to comprise a first jaw and a second jaw, with each jaw terminating in spaced facing edges, said spaced facing edges forming an aperture and a jaw open area in said clamp body, and said linear clamp further comprising a fourth interface element to assist moving said linear clamp in said linear direction.

21. The security tag of claim 20, wherein said linear clamp body includes a second edge that is substantially flat.

22. The security tag of claim 21, wherein said fourth interface element comprises a first side that is substantially flat and disposed within said tag body so that said first side is normal to said second edge, with said fourth interface element being constrained by said tag body except for movement from a first position to a second position around a pivot axis and against said second edge in response to said force.

23. The security tag of claim 22, wherein said fourth interface element receives force and moves from said first position to said second position around said pivot point to contact said second edge thereby moving said linear clamp in said linear direction.

24. The security tag of claim 23, wherein said fourth interface element moves from said second position to said first position around said pivot point when said force is terminated.

25. The security tag of claim 1, further comprising a bridge across said jaw open area.

26. The security tag of claim 25, further comprising a fifth interface element to assist moving said linear clamp in said linear direction.

27. The security tag of claim 26, wherein said linear clamp body includes a second edge that is substantially flat.

28. The security tag of claim 27, wherein said fifth interface element comprises a first side that is substantially flat, said fifth interface element having a first section and a second section, said fifth interface element being disposed within said tag body so that said first section is normal to said second edge, and said second section forms an angle with said second edge, with said third interface element being constrained by said tag body except for movement from a first position to a second position against said bridge in response to said force.

29. The security tag of claim 28, wherein said fifth interface element receives force and moves from said first position to said second position toward said second edge to contact said bridge thereby moving said linear clamp in said linear direction.

30. The security tag of claim 29, wherein said third interface element moves from said second position to said first position when said force is terminated.

31. The security tag of claim 25, further comprising a sixth interface element to assist moving said linear clamp in said linear direction.

32. The security tag of claim 31, wherein said linear clamp body includes a second edge that is substantially flat.

33. The security tag of claim 32, wherein said sixth interface element comprises a first side that is substantially flat with a first end and a pivot element at a second end, said sixth interface element being disposed within said tag body so that said first side is normal to said second edge and said first end corresponds to said bridge, with said second interface element being constrained by said tag body except for movement from a first position to a second position against said bridge in response to said force.

34. The security tag of claim 33, wherein said sixth interface element receives force and moves from said first position to said second position toward said second edge to contact said bridge thereby moving said linear clamp in said linear direction.

35. The security tag of claim 34, wherein said sixth interface element moves from said second position to said first position when said force is terminated.

36. The security tag of claim 25, further comprising a seventh interface element to assist moving said linear clamp in said linear direction.

37. The security tag of claim 36, wherein said linear clamp body includes a second edge that is substantially flat.

38. The security tag of claim 37, wherein said seventh interface element comprises a first side that is substantially flat, with said seventh interface element being disposed within said tag body so that said first side is normal to said second edge, and said seventh interface element being constrained by said tag body except for movement from a first position to a second position against said bridge in response to said force.

39. The security tag of claim 38, wherein said seventh interface element receives force and moves from said first position to said second position toward said second edge to contact said bridge thereby moving said linear clamp in said linear direction.

40. The security tag of claim 39, wherein said seventh interface element moves from said second position to said first position when said force is terminated.

41. A linear clamp for a security tag, comprising:

a clamp body having slots at each end of said body, with each slot substantially perpendicular to a first plane of said clamp body, and substantially parallel to each other in a linear direction;

a spring arm having two ends, with only one end attached to a first edge of said clamp body; and a tack retaining body to retain a tack body.

42. The security tag of claim 41, wherein said slots correspond to a set of guide rails to receive said slots and assist movement in said linear direction.

43. A linear clamp for a security tag, comprising:

a clamp body having slots at each end of said body;

a spring arm having two ends, with only one end attached to a first edge of said clamp body; and a tack retaining body to retain a tack body, said tack retaining body to comprise a first jaw and a second jaw, with each jaw terminating in spaced facing edges, said spaced facing edges forming an aperture and a jaw open area in said clamp body, wherein a second portion of said spaced facing edges are straight to form said jaw open area, with a first distance between a first end of said jaw open area being less than a second distance between a second end of said jaw open area.

44. A linear clamp for a security tag, comprising:

a clamp body having slots at each end of said body;

a spring arm having two ends, with only one end attached to a first edge of said clamp body, said spring arm to comprise a spring arm body that extends along a first edge of said clamp body, and a curved joint joining said spring arm body to one end of said clamp body; and a tack retaining body to retain a tack body.

45. The security tag of claim 43, further comprising a bridge across said jaw open area.

46. A security system, comprising:

a security tag having a linear clamp, said linear clamp to move in a substantially linear direction in response to force to release a tack body from said linear clamp;

a monitoring system to detect said security tag;

an alert system to communicate an alert if said monitoring system detects said security tag; and a detachment device to detach said security tag from an item, said detachment device to include a detachment probe, wherein said detachment probe is an arcuate probe.

47. The security system of claim 46, wherein said security tag further comprises a tag housing and a tack body, with said linear clamp disposed within said tag housing to retain said tack body, and said linear clamp to move in a substantially linear direction in response to force provided by said arcuate probe to release said tack body from said linear clamp.

48. The security system of claim 47, wherein said tag housing includes an arcuate channel to receive said arcuate probe.

* * * * *